US005260181A

United States Patent [19]

Sato et al.

[11] Patent Number: 5,260,181

[45] Date of Patent: Nov. 9, 1993

[54] COLOR-FORMING COUPLER AND A SILVER HALIDE COLOR PHOTOGRAPHIC MATERIAL CONTAINING THE SAME

[75] Inventors: Kozo Sato; Koshin Matsuoka; Yoshio Ishii, all of Kanagawa, Japan

[73] Assignee: Fuji Photo Film Co., Ltd., Kanagawa, Japan

[21] Appl. No.: 796,359

[22] Filed: Nov. 22, 1991

[30] Foreign Application Priority Data

Nov. 22, 1990 [JP] Japan ..... 2-315836

[51] Int. Cl.[5] ..... G03C 7/38

[52] U.S. Cl. ..... 430/558; 430/384; 430/385

[58] Field of Search ..... 430/558, 384, 385

[56] References Cited

U.S. PATENT DOCUMENTS 2,186,685 1/1940 Schneider et al. ..... 430/558
2,396,396 3/1946 Stammers ..... 430/386

FOREIGN PATENT DOCUMENTS 0269436 6/1988 European Pat. Off. .
1-254955 10/1989 Japan ..... 430/558

*Primary Examiner*—Lee C. Wright
*Attorney, Agent, or Firm*—Sughrue, Mion, Zinn, Macpeak & Seas

[57] ABSTRACT

There is disclosed a cyan dye-forming coupler represented by formula (I) and a silver color photographic material containing same.

Formula (I)

wherein EWG represents an electron-attractive group having a Hammett substituent constant $\sigma_p$ value of 0.30 or more, R represents a substituent, l represents an integer of 0 to 2, X represents a hydrogen atom or a group capable of being released upon coupling reaction with the oxidized product of an aromatic primary amine derivative, R and EWG may bond together to form a ring, and when l is 2, two Rs may be the same or different or may bond together to form a ring.

10 Claims, 2 Drawing Sheets

COLOR-FORMING COUPLER AND A SILVER HALIDE COLOR PHOTOGRAPHIC MATERIAL CONTAINING THE SAME

FIELD OF THE INVENTION

The present invention relates to a novel cyan dye-forming coupler used, for example, in silver halide photographic materials and to a silver halide color photographic material containing said coupler.

BACKGROUND OF THE INVENTION

For silver halide color photographic materials, the process for forming a color image by using the reactions of dye-forming couplers that can form yellow, magenta, and cyan with a color-developing agent is currently put to practical use widely.

In recent years, improvements in dye-forming couplers for silver halide color photographic materials have been studied diligently in order to improve color reproduction and fastness of images, but there are restrictions on color-developing agents and it is no yet considered that satisfactory improvements have been made. Particularly with respect to cyan couplers, although phenol couplers and naphthol couplers are conventionally used all the time, dyes produced from these couplers have undesirable absorption in the blue and green regions, which is a hindrance to the improvement in color reproduction. molecular extinction coefficient of the cyan dyes that are produced is low is disadvantageous in view of the improvement of sharpness of images.

Recently, cyan dye-forming couplers having new skeletons with a nitrogen-containing heterocyclic ring are studied actively, and a variety of heterocyclic compounds have been suggested. For example, JP-A ("JP-A" means unexamined published Japanese patent application) No. 226,653/1988 describes diphenylimidazole couplers and JP-A Nos. 199352/1988, 250649/1988, 250650/1988, 554/1989, 555/1989, 105250/1989, and 105251/1989 disclose pyrazoloazole couplers. These couplers are described as improved in color reproduction and are characterized in that the absorption characteristics of the dyes produced therefrom are excellent.

However, the dyes produced from the above couplers have defects that the absorption wave form is biased to the short wave side, the fastness to light and heat is poor, and the coupling activity of the couplers themselves is low, which is a serious problem from the practical point of view.

On the other hand, as dye-forming couplers related to the present invention, 2,4-diarylpyrrole couplers are disclosed in U.S. Pat. No. 2,396,396; but since these couplers react with the oxidized product of a developing agent in such a state that the hydrogen in the 1-position of the pyrrole is not dissociated, there are such problems that the coupling activity is low and stain occurs with time after the development processing, and therefore they have not been practically used.

SUMMARY OF THE INVENTION

The first object of the present invention is to provide a novel cyan dye-forming coupler that gives a dye excellent in absorption characteristics.

The second object of the present invention is to provide a novel cyan dye-forming coupler that gives a dye good in fastness.

The third object of the present invention is provide a silver halide color photographic material wherein the above problems of the prior couplers are improved, color reproduction is excellent, and color images are fast.

Other and further objects, features, and advantages of the invention will be appear more fully from the following description taken in connection with the accompanying drawings.

DETAILED DESCRIPTION OF THE INVENTION

Figure 1:
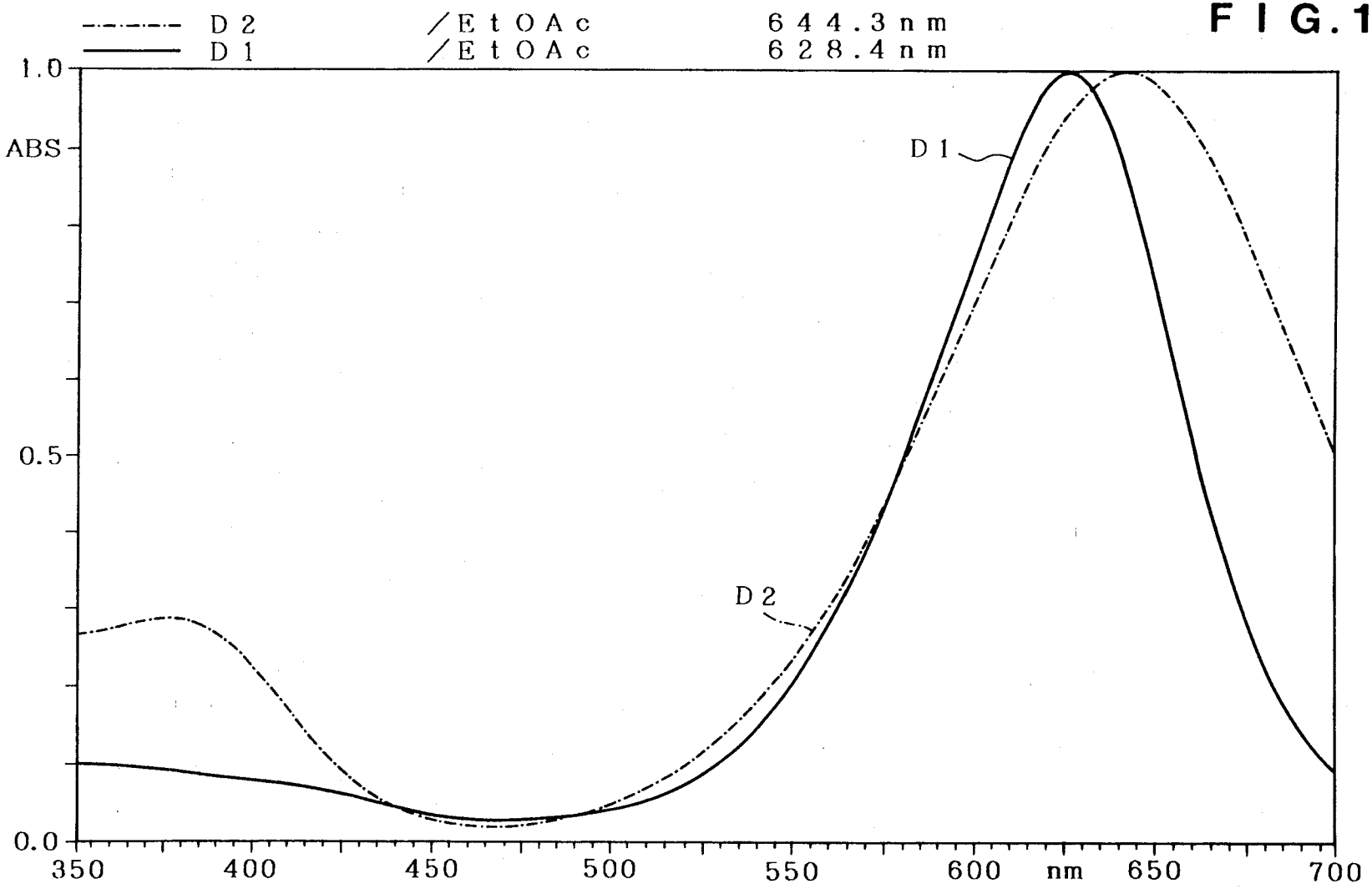
FIGS. 1 and 2 each show diagrams of the absorption spectra of dyes, wherein the absorbance is plotted along the ordinate and the absorption wavelength (nm) is plotted along the abscissa.

The objects of the present invention have been attained by providing (1) a cyan dye-forming coupler represented by the following formula (I):

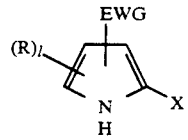

Formula (I)

wherein EWG represents an electron-attractive group having a Hammett substituent constant $\sigma_p$ value of 0.30 or more, R represents a substituent, l represents an integer of 0 to 2, X represents a hydrogen atom or a group capable of being released upon coupling reaction with the oxidized product of an aromatic primary amine derivative, R and EWG may bond together to form a ring, and when l is 2, two Rs may be the same or different or may bond together to form a ring; and (2) a silver halide color photographic material comprising at least one cyan dye-forming coupler stated under (1).

The dye forming coupler of the present invention will now be described in detail.

In formula (I), EWG represents an electron-attractive group having a Hammett substituent constant $\sigma_p$ value of 0.30 or more, preferably 0.30 to 1.0, more preferably 0.50 to 0.9.

Herein, as the value of the Hammett substituent constant $\sigma_p$ value, the value described by Hansch, C. Leo in reports (e.g., *J. Med. Chem.* 16, 1207 (1973); and ibid. 20, 304 (1977)) can be used.

As the electron-attractive group (inclusive of atoms) having a value of $\sigma_p$ of 0.30 or over, for example, a cyano group, a nitro group, an aliphatic and aromatic acyl group (having preferably 1 to 36 carbon atoms, e.g., formyl, acetyl, and benzoyl), a carbamoyl group (having preferably 1 to 50 carbon atoms, e.g., carbamoyl and methylcarbamoyl), a phosphono group, an alkoxycarbonyl group (having preferably 2 to 36 carbon atoms, e.g., methoxycarbonyl, ethoxycarbonyl, and diphenylmethylcarbonyl), a phosphoryl group (having preferably 2 to 36 carbon atoms, e.g., dimethoxyphosphoryl and diphenylphosphoryl), a sulfamoyl group (having preferably 0 to 36 carbon atoms, e.g., sulfamoyl, N-ethylsulfamoyl and N,N-dipropylsulfamoyl), an aliphatic and aromatic sulfonyl group (having preferably 1 to 36 carbon atoms, e.g.,trifluoromethane-sulfonyl, difluoromethanesulfonyl, methanesulfonyl, benzenesulfonyl, and toluenesulfonyl), and a perfluoroalkyl group can be mentioned. Examples of the $\sigma_p$ values of specific groups are 0.66 for a cyano group, 0.78 for a nitro group, 0.50 for an acetyl group, 0.45 for a methoxycarbonyl group, 0.72 for a methanesulfonyl group, 0.54 for a $CF_3$ group, and 0.36 for a carbamoyl group.

A cyano group, an aliphatic or aromatic sulfonyl group, an aliphatic or aromatic acyl group, a perfluoroalkyl group, a carbamoyl group, and an alkoxycarbonyl group are preferable with more preference given to a cyano group, a perfluoroalkyl group, and a carbamoyl group.

Preferably the EWG group is substituted on the 3- or 4- position of the pyrrole ring.

R includes, for example, a halogen atom, an aliphatic group having 1 to 36 carbon atoms, an aromatic group having preferably 6 to 36 carbon atoms (e.g., phenyl, 4-chlorophenyl, hexadecylsulfonamidophenyl, and naphthyl), a heterocyclic group (preferably 5- to 7-membered ring, having preferably 2 to 36 carbon atoms, e.g., 3-pyridyl, 2-furyl, and 2-benzothiazole), an alkoxy group (having preferably 1 to 36 carbon atoms, e.g., methoxy and 2-methoxyethoxy), an aryloxy group (having preferably 6 to 50 carbon atoms, e.g., 2,4-di-tert-amylphenoxy, 2-chlorophenoxy, and 4-cyanophenoxy), an alkenyloxy group (having preferably 2 to 36 carbon atoms, e.g , 2-propenyloxy), an amino group (having preferably 0 to 50 carbon atoms, e.g., amino, butylamino, dimethylamino, anilino, and N-methylanilino), an acyl group (having preferably 1 to 36 carbon atoms, e.g., acetyl and benzoyl), an aliphatic or aromatic oxycarbonyl group (having preferably 2 to 50 carbon atoms, e.g., butoxycarbonyl and phenoxycarbonyl), an acyloxy group (having preferably 2 to 36 carbon atoms, e.g., acetoxy and benzoyloxy), an aliphatic or aromatic oxysulfonyl group (having preferably 1 to 50 carbon atoms, e.g., butoxysulfonyl and phenoxysulfonyl), an acylamino group (having preferably 1 to 50 carbon atoms, e.g., acetylamino), a carbamoyl group (having preferably 0 to 50 carbon atoms, e.g., ethylcarbamoyl, dimethylcarbamoyl, and carbamoyl), a sulfonamido group (having preferably 1 to 50 carbon atoms, e.g., methanesulfonamido), a sulfamoyl group (having preferably 0 to 50 carbon atoms, e.g., sulfamoyl and butylsulfamoyl), a sulfamido group (having preferably to 50 carbon atoms e.g., dipropylsulfamoylamino), an imido group (having preferably 3 to 50 carbon atoms, e.g., succinimido and hydantoyl), an ureido group (having preferably 1 to 50 carbon atoms, e.g., phenylureido and dimethylureido), an aliphatic or aromatic sulfonyl group (having preferably 1 to 36 carbon atoms, e.g., methanesulfonyl and phenylsulfonyl), an aliphatic or aromatic thio group (having preferably 1 to 50 carbon atoms, e.g., ethylthio and phenylthio), a hydroxyl group, a cyano group, a carboxyl group, a nitro group, and a sulfo group. R represents preferably an aromatic group, a heterocyclic group, an alkoxy group, an amido group, an ureido group or an amino group, more preferably an aromatic group, a hetero cyclic group, an amido group, or an ureido group.

In this specification, the term "an aliphatic group" refers to a linear, branched, or cyclic aliphatic hydrocarbon group, which may be saturated or unsaturated and may be substituted such as an alkyl group, an alkenyl group, and an alkynyl group. Representative examples are a methyl group, an ethyl group, a butyl group, a dodecyl group, an octadecyl group, an eicosenyl group, an isopropyl group, a tert-butyl group, a tert-octyl group, a tert-dodecyl group, a cyclohexyl group, a cyclopentyl group, an allyl group, a vinyl group, a 2-hexadecenyl group, and a propargyl group.

l represents an integer of 0 to 2, preferably 1 or 2, and most preferably l is 2.

X represents a hydrogen atom or a group (inclusive of an atom) capable of being released upon coupling reaction with the oxidized product of a developing agent (hereinafter referred to as a coupling split-off group). Specific examples of the coupling split-off group include a halogen atom (e.g., fluorine, chlorine, and bromine), an alkoxy group (e.g., ethoxy, dodecyloxy, methoxyethylcarbamoylmethoxy, carboxypropioxy, and methylsulfonylethoxy), an aryloxy group (e.g., 4-chlorophenoxy, 4-methoxyphenoxy, and 4-carboxyphenoxy), an acyloxy group (e.g., acetoxy, tetradecanoyloxy, and benzoyloxy), an aliphatic or aromatic sulfonyloxy group (e.g., methanesulfonyloxy and toluenesulfonyloxy), an acylamino group (e.g., dichloroacetylamino and heptafluorobutyrylamino), an aliphatic or aromatic sulfonamido group (e.g., methanesulfonamido and p-toluenesulfonamido), an alkoxycarbonyloxy group (e.g., ethoxycarbonyloxy and benzylcarbonyloxy), an aryloxycarbonyloxy group (e.g., phenoxycarbonyloxy), an aliphatic, aromatic, or heterocyclic thio group (e.g., ethylthio, phenylthio, and tetrazolylthio), a carbamoylamino group (e.g., N-methylcarbamoylamino and N-phenylcarbamoylamino), a 5- or 6-membered nitrogen-containing heterocyclic group (e.g., imidazolyl, pyrazolyl, triazolyl, and 1,2-dihydro-2-oxo-1-pyridyl), an imido group (e.g., succinimido and hydantoinyl), an aromatic azo group (e.g., phenylazo), and a carboxyl group, which may be substituted by a group allowed as a substituent for R. The carbon atom number of coupling split-off group having carbon atom is preferably 1 to 36. As a coupling split-off group bonded through a carbon atom, a bis-type coupler can be mentioned which is obtained by condensing a four-equivalent coupler with an aldehyde or a ketone. The coupling split-off group of the present invention may contain a photographically useful group such as a developmentaccelerator and a development retarder. A halogen atom, an aryloxy group, and an arylthio groups are preferable.

R and EWG may bond together to form a ring, for example, as shown below.

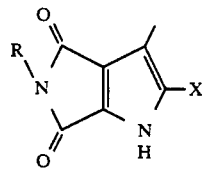

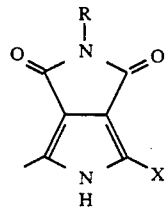

-continued

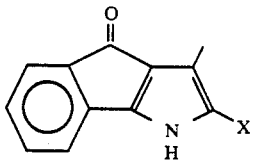

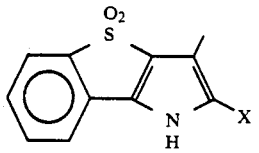

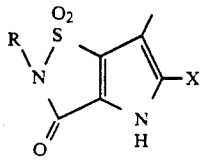

The coupler represents by formula (I) may be used to be contained in a silver halide color photographic material, that is, may be used in the form of a so-called coupler-in-emulsion or may be used to be contained in a color developer, that is, may be used in the form of a so-called coupler-in-developer. The coupler that will be used as a coupler-in-emulsion is one wherein, in formula (I) preferably at least one of R, EWG, and X has 10 to 50 carbon atoms in all.

The coupler of the present invention is effective as a cyan coupler.

Specific examples of the present dye-forming coupler are shown below, but the present invention is not restricted to them.

(1)

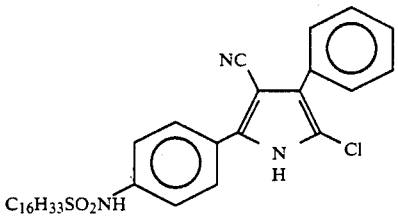

(2)

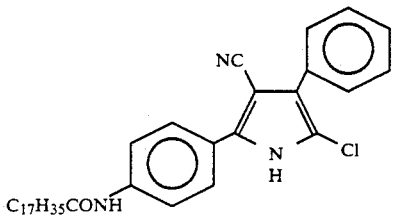

-continued (3)

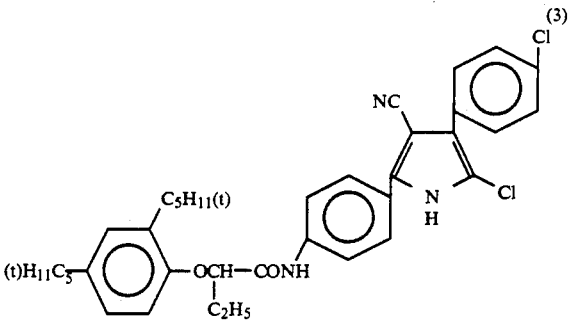

(4)

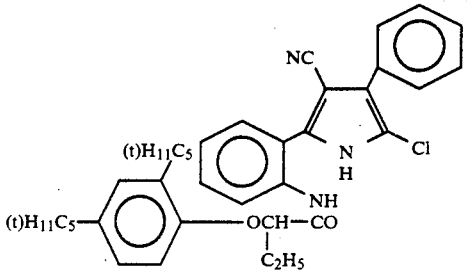

(5)

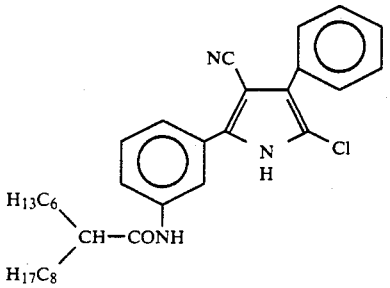

(6)

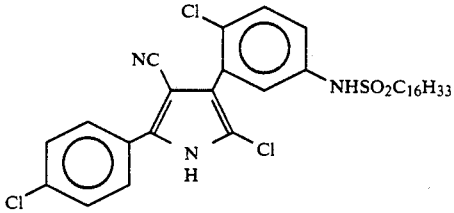

(7)

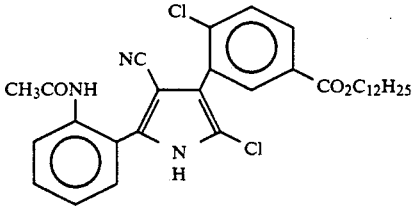

(8)

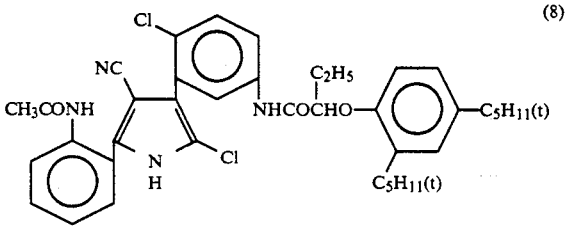

-continued
(9)
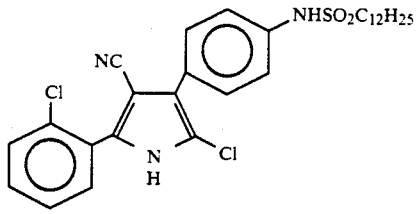
(10)
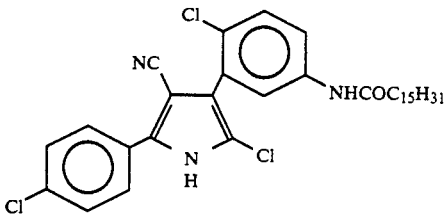
(11)
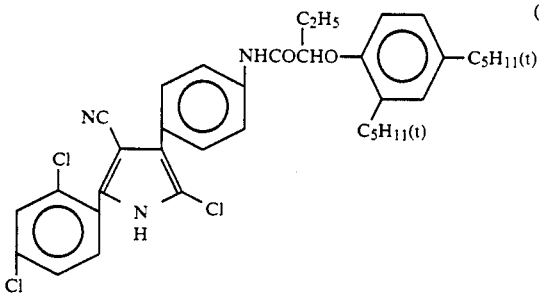
(12)
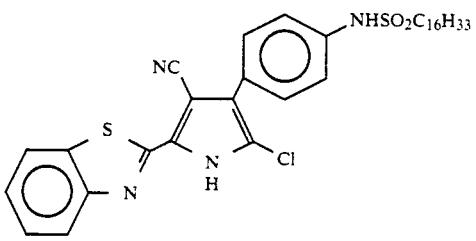
(13)
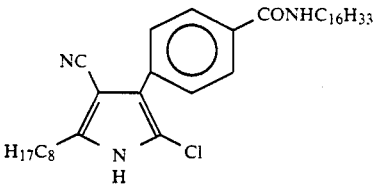
(14)
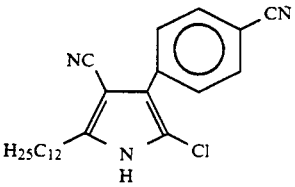
(15)
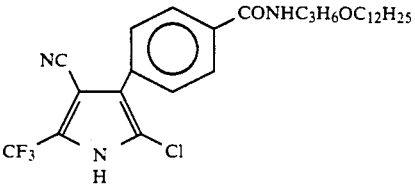
-continued
(16)
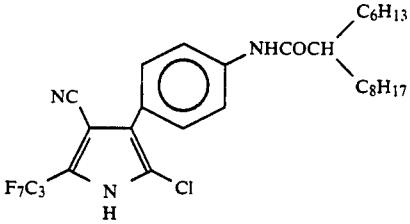
(17)
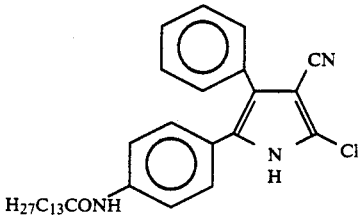
(18)
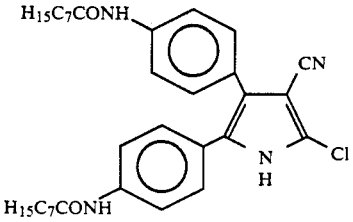
(19)
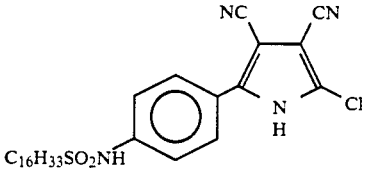
(20)
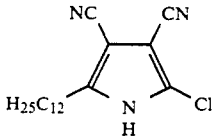
(21)
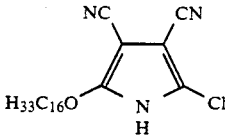
(22)
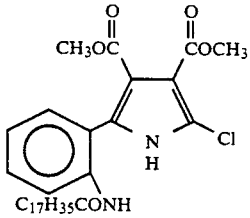
(23)
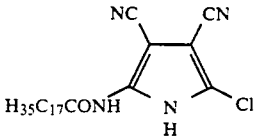

-continued
(24)
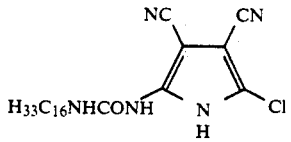
(25)
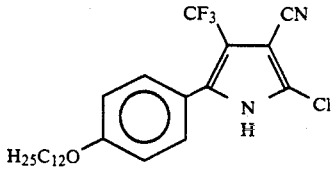
(26)
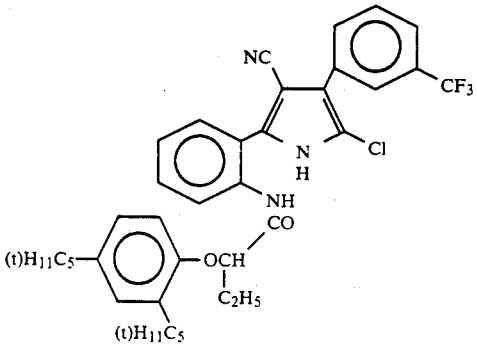
(27)
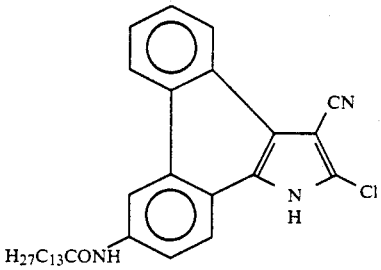
(28)
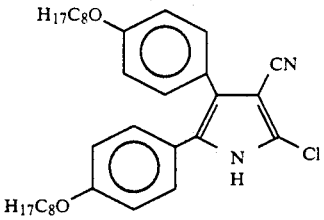
(29)
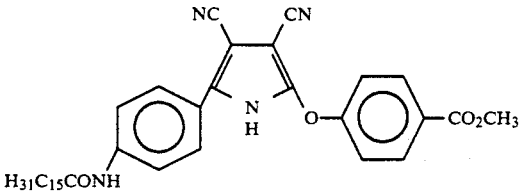
(30)
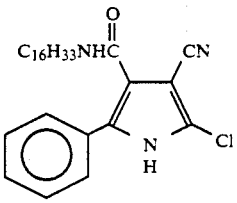
-continued
(31)
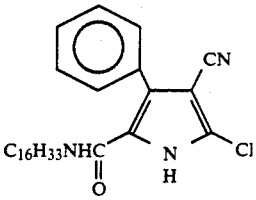
(32)
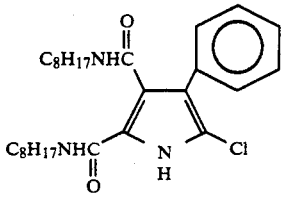
(33)
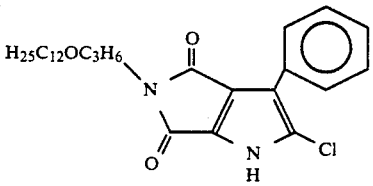
(34)
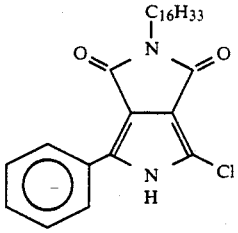
(35)
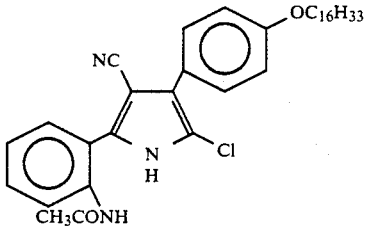
(36)
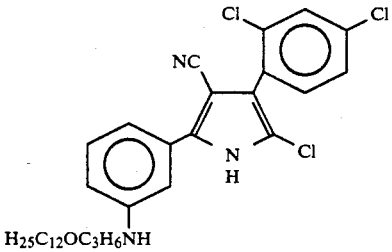
(37)
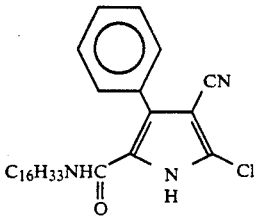

-continued
(38)
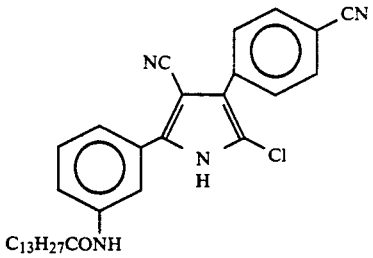
(39)
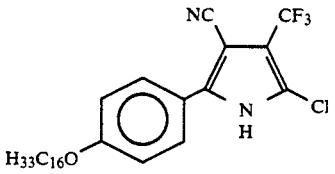
(40)
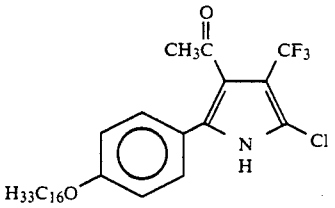
(41)
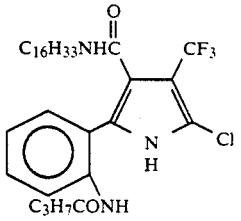
(42)
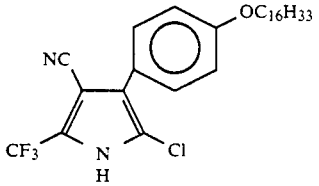
(43)
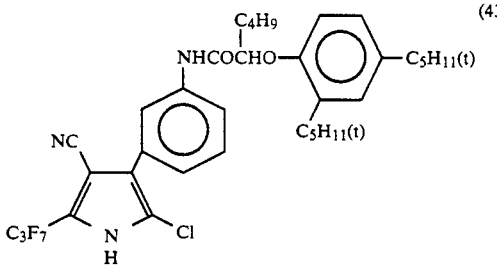
(44)
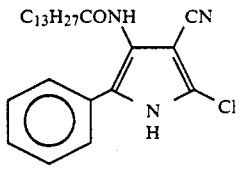
-continued
(45)
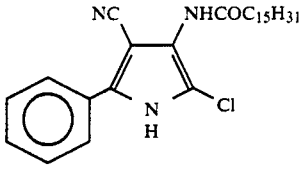
(46)
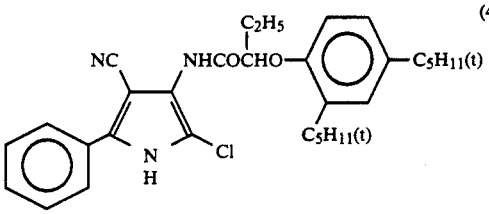
(47)
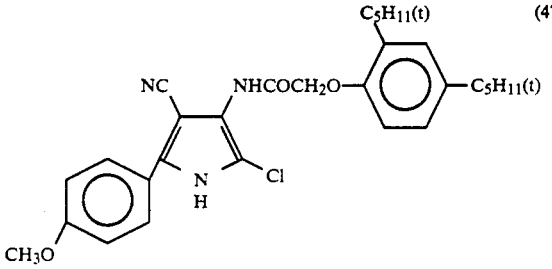
(48)
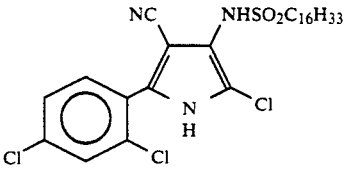
(49)
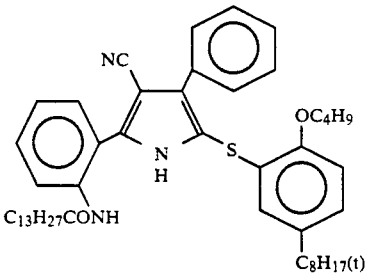
(50)
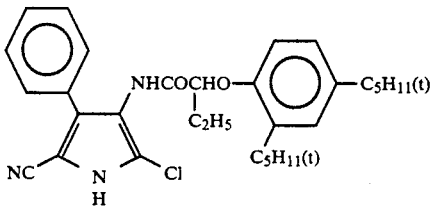
(51)
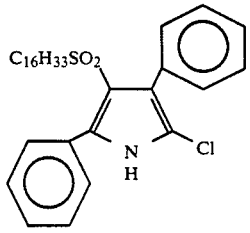

-continued (52)

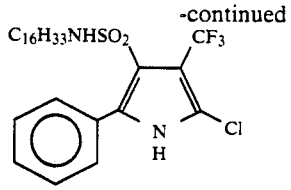

(53)

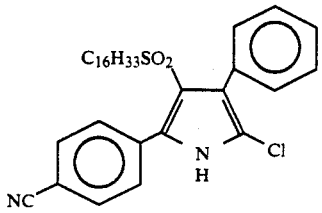

(54)

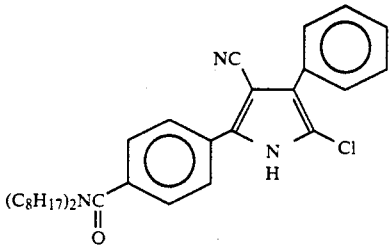

(55)

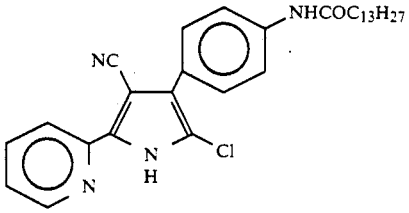

(56)

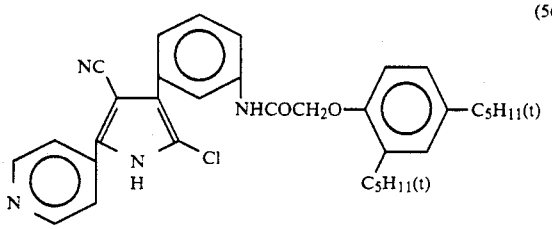

(59)

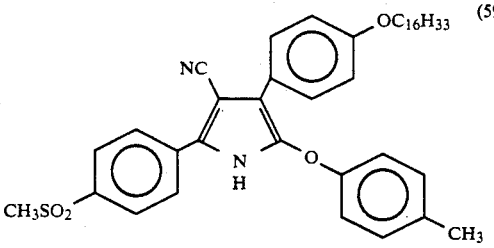

(60)

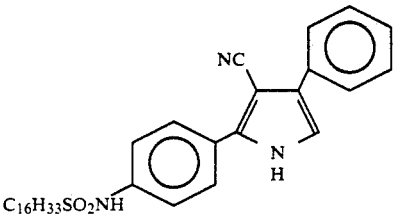

The $\lambda_{max}$ of the cyan dye that will be formed from the present cyan dye forming coupler is in the range of 580 to 700 nm. To synthesize the present dye-forming coupler, several known methods can be used. For example, reaction between a TOSMIC derivative and an electrophilic olefin, and reaction between an azirin compound and a $\beta$-diketone, a $\beta$-ketonitrile, or the like can be mentioned.

The coupler represented by formula (I) of the present invention causes coupling reaction with the oxidized product of a developing agent to form a dye. The formed dye can be used as a cyan dye in various applications (e.g., as a dye in filters, paints, inks, and images and for information recording and printing).

When the coupler represented by formula (I) of the present invention is applied to a silver halide photographic material, it is sufficient that at least one layer containing the coupler of the present invention is present on a base and said layer is a hydrophilic colloid layer. A common color photographic material can be composed of a blue-sensitive silver halide emulsion layer, a green-sensitive silver halide emulsion layer, and a red-sensitive silver halide emulsion layer on a base, which are applied in the stated order. The order may be changed. An infrared-sensitive silver halide emulsion layer may be used instead of one of the above photosensitive emulsion layers. By incorporating, in these photosensitive emulsion layers, silver halide emulsions sensitive to respective wavelength regions and couplers capable of forming dyes complementary to lights to which they are sensitive, color reproduction by the subtractive color process can be carried out. However, the hues of formed colors of color couplers and photosensitive emulsion layers may not be constituted to have the correspondence mentioned above.

When the coupler of the present invention is applied to a color photographic material, particularly preferably the coupler is used in a red-sensitive silver halide emulsion layer.

The amount of the coupler of the present invention to be added to a photographic material is $1\times10^{-3}$ to 1 mol, preferably $2\times10^{-3}$ to $3\times10^{-1}$ mol, per mol of the silver halide.

If the coupler of the present invention is soluble in an aqueous alkali solution, the coupler can be used in coupler-in-developer-type development to form a dye image by dissolving the coupler together with a developing agent and other additives in the aqueous alkali solution. In that case, the amount to be added is 0.0005 to 0.05 mol, preferably 0.005 to 0.02 mol, per liter of the color developer.

The coupler of the present invention can be introduced into a photographic material by various known dispersion methods, and preferably is introduced into a photographic material by the oil-in-water dispersion method, wherein the coupler is dissolved in a high-boiling organic solvent (and, if required, a low-boiling organic solvent), the solution is emulsified and dispersed into an aqueous gelatin solution, and the emulsified dispersion is added to a silver halide emulsion.

Examples of high-boiling solvents used in the oil-in-water dispersion method are described, for example, in U.S. Pat. No. 2,322,037. The steps, effects, and specific examples of latices for dispersion in the latex dispersion method, which is one of the polymer dispersion method, are described, for example, in U.S. Pat. No. 4,199,363, West German Patent Applications (OLS) 2,541,274 and 2,541,230, JP-B ("JP-B" means examined Japanese patent publication) No. 41091/1978 and European Patent Publication No. 029104 and the dispersion method by an organic-solvent-soluble polymer is described in PCT International Publication W088/00723.

High-boiling organic solvents that can be used in the above oil-in-water dispersion method are, for example, a phthalate (e.g., dibutyl phthalate, dioctyl phthalate, dicyclohexyl phthalate, di-2-ethylhexyl phthalate, decyl phthalate, bis(2,4-di-tert-amylphenyl) isophthalate, and bis(1,1-diethylpropyl) phthalate), a phosphate or phosphonate (e.g., diphenyl phosphate, triphenyl phosphate, tricresy phosphate, 2-ethylhexyldiphenyl phosphate, dioctylbutyl phosphate, tricyclohexyl phosphate, tri-2-ethylhexyl phosphate, tridodecyl phosphate, and di-2-ethylhexylphenyl phosphate), a benzoate (e.g., 2-ethylhexyl benzoate, a 2,4-dichlorobenzoate, dodecyl benzoate, and 2-ethylhexyl-p-hydroxybenzoate), an amide (e.g., N,N-diethyldodecaneamide and N,N-diethyllaurylamide), an alcohol or a phenol (e.g., isostearyl alcohol and 2,4-di-tert-amylphenol), an aliphatic ester (e.g., dibutoxyethyl succinate, di-2-ethylhexyl succinate, 2-hexyldecyl tetradecanoate, tributyl citrate, diethyl azelate, isostearyl lactate, and trioctyl oleate), an aniline derivative (e.g., N,N-dibutyl-2-butoxy-5-tert-octylaniline), a chlorinated paraffin (e.g., a paraffin having a chlorine content of 10 to 80%), a trimesate (e.g., tributyl trimesate), dodecylbenzene, diisopropylnaphthalene, a phenol (e.g., 2,4-di-tert-amylphenol, 4-dodecyloxyphenol, and 4-dodecyloxycarbonylphenol, 4-(4-dodecyloxyphenylsulfonyl)phenol), a carboxylic acid (e.g., 2-(2,4-di-tert-amylphenoxybutyric acid and 2-ethoxyoctadecanoic acid), and an alkylphosphoric acid (e.g., di-(2-ethylhexyl)phosphoric acid and diphenylphosphoric acid). As a co-solvent, an organic solvent having a boiling point of as high as about 30° C. and as low as about 160° C. (e.g., ethyl acetate, butyl acetate, ethyl propionate, methyl ethyl ketone, cyclohexanone, 2-ethoxyethyl acetate, and dimethylformamide) may be additionally used.

For the coupler of the present invention, a so-called polar high-boiling organic solvent is preferable among the high-boiling organic solvents mentioned above, and in particular an amide is more preferable. As amide high-boiling organic solvents, in addition to the those mentioned above, those described, for example, in U.S. Pat. Nos. 2,322,027, 4,127,413, and 4,745,049 can be used. In particular, high-boiling organic solvents having a specific inductive capacity (measured at 25° C. and 10 Hz) of as low as about 6.5, preferably 5 to 6.5 are preferable.

The high-boiling organic solvent is used in a weight ratio of from 0 : 1 to 2.0 : 1, preferably from 0: 1 to 1.0:1, to the coupler.

The coupler of the present invention can be applied, for example, to color print papers, color reversible papers, direct positive color photographic materials, color negative films, color positive films, and color reversal films. Among them, application to color photographic materials having a reflective base (e.g., color print papers and color reversible papers) is preferable.

As the silver halide emulsion to be used in the present invention, silver halide emulsions having any halogen composition, such as silver bromoiodide, silver bromochloroiodide, silver bromide, silver bromochloride, and silver chloride can be used.

Preferable composition of silver halide is different each other according to the kind of photographic material to be adapted, for example, a silver chlorobromide emulsion is used mainly for a color paper, a silver iodobromide emulsion is used for a color negative film of photographic purpose, and a silver bromide emulsion and a silver chlorobromide emulsion are used for a direct positive color photographic material. An emulsion, so-called high-silver chloride emulsion is preferably used for a photographic material of color paper that is suitable for a rapid processing. The silver chloride content of this high-silver halide emulsion is preferably 90 mol. % or more, more preferably 95 mol. % or more.

In these high-silver-chloride emulsions, the structure is preferably such that the silver bromide localized layer in the layered form or nonlayered form is present in the silver halide grain and/or on the surface of the silver halide grain as mentioned above. The silver bromide content of the composition of the above-mentioned localized layer is preferably at least 10 mol. %, and more preferably over 20 mol. %. The localized layer may be present in the grain, or on the edges, or corners of the grain surfaces, or on the planes of the grains, and a preferable example is a localized layer epitaxially grown on each corner of the grain.

In the present invention, one comprising silver chlorobromide or silver chloride and being substantially free from silver iodide can be preferably used. Herein the term "substantially free from silver iodide" means that the silver iodide content is 1 mol. % or below, and preferably 0.2 mol. % or below.

Although the halogen compositions of the emulsions may be the same or different from grain to grain, if emulsions whose grains have the same halogen composition are used, it is easy to make the properties of the grains homogeneous. With respect to the halogen composition distribution in a silver halide emulsion grain, for example, a grain having a so-called uniform-type structure, wherein the composition is uniform throughout the silver halide grain, a grain having a so-called layered-type structure, wherein the halogen composition of the core of the silver halide grain is different from that of the shell (which may comprises a single layer or layers) surrounding the core, or a grain having a structure with nonlayered parts different in halogen composition in the grain or on the surface of the grain (if the nonlayered parts are present on the surface of the grain, the structure has parts different in halogen composition joined onto the edges, the corners, or the planes of the grain) may be suitably selected and used. To secure high sensitivity, it is more advantageous to use either of the latter two than to use grains having a uniform-type structure, which is also preferable in view of the pressure resistance. If the silver halide grains have the above-mentioned structure, the boundary section between parts different in halogen composition may be a clear boundary, or an unclear boundary, due to the formation of mixed crystals caused by the difference in composition, or it may have positively varied continuous structures.

The average grain size of the silver halide grains contained in the silver halide emulsion to be used in the present invention (the diameter of a circle equivalent to the projected area of the grain is assumed to be the grain size, and the number average of grain sizes is assumed to be an average grain size) is preferably 0.1 to 2 μm, more preferably 0.15 to 1.5 μm. Further, the grain size distribution thereof is preferably one that is a so-called monodisperse dispersion, having a deviation coefficient (obtained by dividing the standard deviation of the grain size by the average grain size) of 20% or below, and desirably 15% or below. In this case, for the purpose of obtaining one having a wide latitude, it is also preferable that monodisperse emulsions as mentioned above are blended to be used in the same layer, or are applied in layers.

As to the shape of the silver halide grains contained in the photographic emulsion, use can be made of grain in a regular crystal form, such as cubic, tetradecahedral, or octahedral, or grains in an irregular crystal form, such as spherical or planar, or grains that are a composite of these. Also, tabular grains are preferable.

As the emulsion to be used in the present invention, use is made any of a so-called surface latent image-type emulsion, wherein a latent image is formed mainly on the grain surface, or of a so-called internal latent image-type emulsion, wherein a latent image is formed mainly within the grains.

The silver chloromide emulsion used in the present invention can be prepared by methods described, for example, in *I. Emulsion Preparation and Types*, in *Research Disclosure* (RD), No. 17643 (December 1978), pp. 22–23, and in ibid, No. 18716 (November 1979, p. 648; by P. Glafkides, in *Chimie et Phisique Photographique* (published by Paul Montel, 1967); by G. F. Duffin in *Photographic Emulsion Chemistry* (published by Focal Press, 1966), and by V. L. Zelikman et al. in *Making and Coating Photographic Emulsion* (published by Focal Press, 1964).

A monodisperse emulsion, such as described in U.S. Pat. Nos. 3,574,628 and 3,655,394, and in British Patent No. 1,413,748, is also preferable.

Tabular grains having an aspect ratio of 5 or greater can be used in the present invention. Tabular grains can be easily prepared by the methods described in Gutoff *Photographic Science and Engineering*, Vol. 14, pp. 248–257 (1970), U.S. Pat. Nos. 4,434,226, 4,414,310, 4,433,048, and 4,439,520, and British Patent No. 2,112,157.

The crystal structure of the emulsion grains may be uniform, the outer halogen composition of the crystal structure may be different from the inner halogen composition, or the crystal structure may be layered. Silver halides whose compositions are different may be joined by the epitaxial joint, or a silver halide may be joined, for example, to a compound other than silver halides, such as silver rhodanide, lead oxide, etc.

Further, the silver halide may be a mixture of grains having various crystal shapes.

The silver halide emulsion for use in the present invention may be physically ripened, chemically ripened, and spectrally sensitized.

Into the silver halide emulsion to be used in the present invention can be introduced various polyvalent metal ion impurities in the process of the formation or physical ripening of the emulsion grains. Examples of the compound to be used include a salt of cadmium, zinc, lead, copper, thulium, etc., and a salt or complex salt of iron, ruthenium, rhodium, palladium, osmium, iridium, and platinum that are elements of Group VIII.

Additives that will be used in physical ripening, chemical ripening, and spectral sensitization of the silver halide emulsion for use in the present invention are described in *Research Disclosure* Nos. 17643, 8716, and 307105, and the involved sections are listed in the Table below. Known photographic additives that can be used in the present invention are also described in the above-mentioned three *Research Disclosures*, and the involved sections are listed in the same Table below.

| | Additive | RD 17643 | RD 18716 | RD 307105 |
|---|---|---|---|---|
| 1 | Chemical sensitizer | p. 23 | p. 648 (right column) | p. 866 |
| 2 | Sensitivity-enhancing agent | — | p. 648 (right column) | — |
| 3 | Spectral sensitizers and Supertabilizers | pp. 23–24 | pp. 648 (right column)–649 (right column) | pp. 866–868 |
| 4 | Brightening agents | p. 24 | p. 647 (right column) | p. 868 |
| 5 | Antifogging agents and Stabilizers | pp. 24–25 | p. 649 (right column) | pp. 868–870 |
| 6 | Light absorbers, Filter dyes, and UV Absorbers | pp. 25–26 | pp. 649 (right column)–650 (left column) | p. 873 |
| 7 | Stain-preventing agent | p. 25 (right column) | p. 650 (left to right column) | p. 872 |
| 8 | Image dye stabilizers | p. 25 | p. 650 (left column) | p. 872 |
| 9 | Hardeners | p. 26 | p. 651 (left column) | pp. 874–875 |
| 10 | Binders | p. 26 | p. 651 (left column) | pp. 873–874 |
| 11 | Plasticizers and Lubricants Lubricants | p. 27 | p. 650 (right column) | p. 876 |
| 12 | Coating aids and Surface-active agents | pp. 26–27 | p. 650 (right column) | pp. 875–876 |
| 13 | Antistatic agents | p. 27 | p. 650 (right column) | pp. 876–877 |
| 14 | Matting agent | — | — | pp. 878–879 |

Further, in order to prevent the lowering of photographic performances due to formaldehyde gas, a compound described in, for example, U.S. Pat. Nos. 4,411,987 and 4,435,503 that is able to react with formaldehyde to immobilize it can be added to the photographic material.

Various color couplers can be used in this invention, and typical examples are described in the patents in the above-mentioned *Research Disclosure* No. 7643, VII-C to G.

As yellow couplers, those described, for example, in U.S. Pat. Nos. 3,933,501, 4,022,620, 4,326,024, 4,401,752, and 4,428,961, JP-B No. 10739/1983, British Patent Nos. 1,425,020 and 1,476,760, U.S. Pat. Nos. 3,973,968, 4,314,023, and 4,511,649, and European Patent No. 249,473A are preferable.

From the standpoint of color reproduction, preferably the coupler of the present invention is used in combination with a yellow coupler wherein the wavelength of maximum absorption by the color-formed dye is on the short wavelength side and the absorption at the long wavelength over 500 nm decreases sharply. Such couplers are described, for example, in JP-A Nos. 123047/1988 and 173499/1989.

As magenta couplers, the 5-pyrazolone type and pyrazoloazole type are preferable, and those described in U.S. Pat. Nos. 4,310,619 and 4,315,897, European Patent No. 73,636, U.S. Pat. Nos. 3,061,432 and 3,725,067, *Research Disclosure* No. 24220 (June 1984), JP-A No. 3552/1985, *Research Disclosure* No. 24230 (June 1984), JP-A Nos. 43659/1985, 72238/1986, 35730/1985, 118034/1980, and 185951/1985, U.S. Pat. Nos. 4,500,630, 4,540,654, and 4,556,630, and International Patent Publication No. WO 88/04795 are particularly preferable.

As cyan couplers, the phenol-type couplers and naphthol-type couplers can be used in combination with the coupler of the present invention, and those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German Patent Application (OLS) No. 3,329,729, European Patent Nos. 121,365A and 249,453A, U.S. Pat. Nos. 3,446,622, 4,333,999, 4,775,616, 4,451,559, 4,427,767, 4,690,889, 4,254,212, and 4,296,199, and JP-A No. 2658/1986 are more preferable.

As a colored coupler to rectify the unnecessary absorption of color-forming dyes, those couplers described in paragraph VII-G of *Research Disclosure* No. 17643, U.S. Pat. No. 4,163,670, JP-B No. 39413/1982, U.S. Pat. Nos. 4,004,929, and 4,138,258, British Patent No. 1,146,368 are preferable. Further, it is preferable to use couplers to rectify the unnecessary absorption of color-forming dye by fluorescent dye released upon the coupling described in U.S. Pat. No. 4,774,181 and couplers having a dye precursor, as a group capable of being released, that can react with the developing agent to form a dye described in U.S. Pat. No. 4,777,120.

As a coupler which forms a dye having moderate diffusibility, those described in U.S. Pat. No. 4,366,237, British Patent No. 2,125,570, European Patent No. 96,570, West German Patent Application (OLS) No. 3,234,533 are preferable.

Typical examples of a polymerized dye-forming coupler are described in U.S. Pat. Nos. 3,451,820, 4,080,211, 4,367,282, 4,409,320, and 4,576,910, and British Patent No. 2,102,173.

A coupler that releases a photographically useful residue accompanied with the coupling reaction can be used favorably in this invention. As a DIR coupler that releases a development retarder, those described in patents cited in paragraph VII-F of the above-mentioned *Research Disclosure No.* 17643, JP-A Nos. 151944/1982, 154234/1982, 184248/1985, 37346/1988, and 37350/1988, and U.S. Pat. Nos. 4,286,962 and 4,782,012 are preferable.

As a coupler which releases, imagewisely, a nucleating agent or a development accelerator upon developing, those described in British Patent Nos. 2,097,140 and 2,131,188, and JP-A Nos. 157638/1984 and 170840/1984 are preferable.

Other couplers that can be incorporated in the photographic material of this invention include competitive couplers described in U.S. Pat. No. 4,130,427, multi-equivalent couplers described in U.S. Pat. Nos. 4,283,472, 4,338,393, and 4,310,618, couplers which release a DIR redox compound, couplers which release a DIR coupler, and redox compounds which release a DIR coupler or a DIR redox described in JP-A Nos. 185950/1985 and 24252/1987, couplers which release a dye to regain a color after releasing described in European Patent Nos. 173,302A and 313,308A, couplers which release a bleaching-accelerator described in RD. Nos. 11449 and 24241, and JP-A No. 201247/1986, couplers which release a ligand described in U.S. Pat. No. 4,553,477, couplers which release a leuco dye described in JP-A No. 75747/1988, and couplers which release a fluorescent dye described in U.S. Pat. No. 4,774,181.

The amount of color couplers to be used in combination is, as a standard, in a range from 0.001 to 1 mol, and preferably 0.01 to 0.5 mol for yellow coupler, 0.003 to 0.3 mol for magenta coupler, and 0.002 to 0.3 mol, per mol of photosensitive silver halide.

These couplers that can be used in combination with coupler of the present invention can be incorporated by various known dispersing processes.

The photographic material of the present invention may contain, as color antifoggant, for example, a hydroquinone derivative, an aminophenol derivative, a gallic acid derivative, or an ascorbic acid derivative.

In the photographic material according to the present invention, various anti-fading agent (discoloration preventing agent) can be used. That is, as organic anti-fading additives for cyan, magenta and/or yellow images, hydroquinones, 6-hydroxychromans, 6-hydroxycoumarans, spirochromans, p-alkoxyphenols, hindered phenols, including bisphenols, gallic acid derivatives, methylenedioxybenzenes, aminophenols, hindered amines, and ether or ester derivatives obtained by silylating or alkylating the phenolic hydroxyl group of these compounds can be mentioned typically. Metal complexes such as (bissalicylaldoximato)nickel complex and (bis-N,N-dialkyldithiocarbamato)nickel complexes can also be used.

As specific examples of the organic anti-fading agents can be mentioned hydroquinones as described, for example, in U.S. Pat. Nos. 2,360,290, 2,418,613, 2,700,453, 2,701,197, 2,728,659, 2,732,300, 2,735,765, 3,982,944, and 4,430,425, British Patent No. 1,363,921, and U.S. Pat. Nos. 2,710,801 and 2,816,028; 6-hydroxychromans, 5-hydroxycoumarans, and spirochromans as described, for example, in U.S. Pat. Nos. 3,432,300, 3,573,050, 3,574,627, 3,698,909, and 3,764,337 and JP-A No.152225/1987; spiroindanes as described in U.S. Pat. No. 4,360,589; p-alkoxyphenols as described, for example, in U.S. Pat. No. 2,735,765, British Patent No. 2,066,975, JP-A No. 10539/1984, and JP-B No. 19765/1982; hindered phenols as described, for example, in U.S. Pat. Nos. 3,700,455, JP-A No. 72224/1977, U.S. Pat. No. 4,228,235, and JP-B No. 6623/1977; gallic acid derivatives as described, for example, in U.S. Pat. No. 3,457,079; methylenedioxybenzenes as described, for example, in U.S. Pat. No. 4,332,886; aminophenols as described, for example, in JP-B No. 21144/1981; hindered amines as described, for example, in U.S. Pat. Nos. 3,336,135 and 4,268,593, British Patent Nos. 1,326,889, 1,354,313, and 1,410,846, JP-B No. 1420/1976, and JP-A Nos. 114036/1983, 53846/1984, and 78344/1984; and metal complexes as described, for example, in U.S. Pat. Nos. 4,050,938 and 4,241,155 and British Patent 2,027,731(A) To attain the purpose, these compounds can be added to the photosensitive layers by coemulsifying them with the corresponding couplers, with the amount of each compound being generally 5 to 100 wt. % for the particular coupler. To prevent the cyan dye image from being deteriorated by heat, and in particular light, it is more effective to introduce an ultraviolet absorber into the cyan color-forming layer and the opposite layers adjacent to the cyan color-forming layers.

As the ultraviolet absorber, aryl-substituted benzotriazole compounds (e.g., those dscribed in U.S. Pat. No. 3,533,794), 4-thiazolidone compounds (e.g., those described in U.S. Pat. Nos. 3,314,794 and 3,352,681), benzophenone compounds (e.g., those described in JP-A No. 2784/1971), cinnamic acid ester compounds (e.g., those described in U.S. Pat. Nos. 3,705,805 and 3,707,395), butadiene compounds (e.g., those described in U.S. Pat. No. 4,045,229) or benzoxazol compounds (e.g., those described in U.S. Pat. No. 3,700,455) can be used. Ultraviolet absorbing couplers (e.g., α-naphthol type cyan dye-forming couplers) and ultraviolet-absorbing polymers can, for example, be used. These ultraviolet-absorbing agents may be mordanted in a particular layer.

In particular, the above-mentioned aryl-substituted benzotriazole compounds are preferable.

As a binder or a protective colloid that can be used in the emulsion layers of the photographic material of the present invention, gelatin is advantageously used, but other hydrophilic colloids can be used alone or in combination with gelatin.

In the present invention, gelatin may e lime-processed gelatin or acid-processed gelatin. Details of the manufacture of gelatin is described by Arther Veis in *The Macromolecular Chemistry of Gelatin* (published by Academic Press, 1964).

In the photographic material of the present invention various antiseptics and antifungal agents, such as 1,2-benzisothiazoline-3-one, n-butyl-p-hydroxybenzoate, phenol, 4-chloro-3,5-dimethylphenol, 2-phenoxyethanol, and 2-(4-thiazolyl)benzimidazole described, for example, in JP-A Nos. 257747/1988, 272248/1987 and 80941/1989, are preferably added.

When the photographic material of the present invention is a direct positive color photographic material, a nucleating agent, such as hydrazine compound or quarternary heterocyclic compound as described, for example, in *Research Disclosure* No. 22534 (January, 1983), and a nucleating accelerator that enhance the effect of nucleating agent can be used.

As a base to be used in the present invention, a transparent film, such as cellulose nitrate film, and polyethylene terephthalate film or a reflection-type base that is generally used in photographic materials can be used. The use of a reflection-type base is more preferable.

The "reflection base" is one that enhances reflectivity, thereby making sharper the dye image formed in the silver halide emulsion layer, and it includes one having a base coated with a hydrophobic resin containing a dispersed light-reflective substance, such as titanium oxide, zinc oxide, calcium carbonate, and calcium sulfate, and also a base made of a hydrophobic resin containing a dispersed light-reflective substance. For example, baryta papers; polyethylene-coated papers; polypropylene-type synthetic papers; and transparent bases having additionally a reflective layer or using additionally a reflective substance (e.g., glass plates; polyester films of poly-ethylene terephthalate, cellulose triacetate, or cellulose nitrate; polyamide films; polycarbonate films; polystyrene films; and vinyl chloride resin) can be mentioned.

The photographic material according to the present invention can be developed by the usual method described in the above RD No. 17643, pages 28 to 29, and ibid No. 18716, page 615, the left column to the right column. For example, the color development processing comprises a color development processing step, a desilvering step, and a washing step. If reversal development processing is carried out, a black-and-white development processing step, a washing or rising step, a reversal processing step, and a color development processing step are effected. In the desilvering step, instead of a bleaching step using a bleaching solution and a fixing step using a fixing solution, a bleach-fixing step using a bleach-fixing solution can be carried out or a bleaching step, a fixing step, and a bleach-fixing step can be combined in any order. Instead of a washing step, a stabilizing step can be carried out, and after a washing step, a stabilizing step can be carried out. Also a monobath processing step using a monobath bleach-fixing solution, wherein color development, bleaching, and fixing are effected in one bath, can be carried out. In addition to these processing steps, a prehardening step, a step of neutralizing it, a stop-fixing step, an after-hardening step, an compensating step, an intensifying step, etc., may be carried out. Between these steps, an intermediate washing step may be arbitrarily provided. In these steps, instead of the color development processing step, a so-called activator processing step may be carried out.

The color developer used in development processing for the photographic material of the present invention is an aqueous alkaline solution whose major component is an aromatic primary amine color-developing agent. As the color-developing agent, an aminophenol compound is useful but a p-phenylenediamine compound is preferably used, and typical examples thereof are 3-methyl-4-amino-N,N-diethylaniline, 3-methyl-4-amino-N-ethyl-N-β-hydroxyethylaniline, 4-amino-N-ethyl-N-β-hydroxyethylaniline, 3-methyl-4-amino-N-ethyl-N-β-methanesulfonamidoethylaniline, and 3-methyl-4-amino-N-ethyl-β-methoxyethylaniline and their sulfates, hydrochlorides, and p-toluenesulfonates, which may be used as a mixture of two or more depending on the purpose.

The color developer generally contains a pH buffer, such as the carbonate, borate, and phosphate of an alkali metal and an antifoggant or a development retarder, such as a chloride, a bromide, an iodide, a benzimidazole, a benzothiazole, or a mercapto compound. If necessary, for example, various preservatives, such as hydroxylamine, diethylhydroxylamine, sulfites, and hydrazines, for example N,N-biscarboxymethylhydrazine, phenylsemicarbazide, triethanolamine, and catecorsulfonic acids; organic solvents, such as ethylene glycol and diethylene glycol; development accelerators, such as benzyl alcohol, polyethylene glycol, quaternary ammonium salts, and amines; dye-forming couplers; competing couplers; auxiliary developing agents, such as 1-phenyl-3-pyrazolidone; nucleating agents, such as sodium boron hydride and hydrazine compounds; tackifiers; various chelating agents, represented by aminopolycarboxylic acids, aminopolyphosphonic acids, alkylphosphonic acids, and phosphonocarboxylic acids (e.g., ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, and ethylenediamine-di(o-hydroxyphenylacetic acid) and their salts; brightening agents, such as 4,4'-diamino-2,2'-disulfostylbene; and various surface-active agents, such as alkylsulfonic acids, arylsulfonic acids, aliphatic carboxylic acids, and aromatic carboxylic acids, may be added.

Preferably the color developer in the present invention substantially does not contain benzyl alcohol. The term "substantially does not contain benzyl alcohol" means that the content of benzyl alcohol is preferably 2 ml/1 or less, more preferably 0.5 ml/1 or less, and most preferably nil.

Preferably the color developer in the present invention substantially does not contain sulfite ions. The term "substantially does not contain sulfite ions" means that the content of sulfite ions is preferably $3.0\times10^{-3}$ mol/1 or less, more preferably nil.

Preferably the color developer in the present invention substantially does not contain hydroxylamine. The term "substantially does not contain hydroxylamine" means that the content of hydroxylamine is $5.0\times10^{-3}$ mol/1 or less, more preferably nil. Preferably the color developer in the present invention contains any organic preservative other than hydroxylamine (e.g., hydroxylamine derivatives and hydrazine derivatives).

Generally, the pH of these color developer is 9 to 12.

A color reversal development processing includes generally a black-and-white developing process, water-washing or rinse process, a reversal processing process, and a color developing process. The reversal processing process may be a process using a reversal bath containing a fogging agent or a light-reversal processing. Further, the reversal processing may be omitted by incorporating the fogging agent mentioned above in a color developer.

The black-and-white developing solution is such commonly known solution as used in the processing of black and white photographic material, and various additives that are added in usual black-and-white developing solution may be used.

Representative additives that can be mentioned include developing agents, such as 1-phenyl-3-pyrazolidone, N-methyl-p-aminophenol, and hydroquinone; pH-buffers comprising an water-soluble acid, such as acetic acid and boric acid; pH-buffers or development accelerators comprising an alkali, such as sodium hydroxide, sodium carbonate, and potassium carbonate; inorganic or organic development controlling agents, such as potassium bromide, 2-methylbenzimidazole, and methylbenzthiazole; hard water-softeners, such as ethylenediaminetertaacetic acid and polyphosphate; oxidation inhibitors, such as ascorbic acid and diethanolamine; organic solvents, such as triethylene glycol and Cellosolve; and surface over-developing inhibitors, such as slight amount of iodide and mercapto compound.

When the replenishing amount of these developer is reduced, it is preferable to prevent the evaporation and oxidation by air of developer by reducing the contact area of processing bath with air. As a method for reducing the contact area of processing bath with air can be mentioned a method to provide a cover such as floating lid on the surface of photographic processing solution in the bath. It is preferable to adopt this means not only both color developing and black-and-white developing process but also in all succeeding processes. Further, the replenishing amount can be reduced by using means for suppressing the accumulation of bromide ions in developer, such as regenerating method.

Although the processing time of color developing is settled, in generally, between 2 and 5 minutes, the time can be shortened by, for example, processing at high temperature and at high pH, and using a color developer having high concentration of color developing agent.

The photographic emulsion layer are generally subjected to a desilvering process after color development. The desilvering process can be carried out by a bleaching process separately from a fixing process, or carried out at the same time (bleach-fixing process) Further, to quicken the process bleach-fixing may be carried out after the bleaching process. In accordance with the purpose, the process may be arbitrarily carried out using a bleach-fixing bath having two successive tanks, or a fixing process may be carried out before the bleach-fixing process, or a bleaching process. In the present invention, it is effective that a bleach-fixing process is carried out immediately after the color development processing.

The bleaching agent to be used for a bleaching solution and bleach-fixing solution that can be mentioned include, for example, compounds of polyvalent metals, such as iron (III), peroxy acids, quinones, and iron salts. As typical bleaching agent can be mentioned iron chlorides; ferricyanides; bichromates; organic complex salts of iron (III) (e.g., such as complex salts of aminopolycarboxylic acids, for example ethylenediaminetetraacetic acid, diethylenetriaminetetraacetic acid, and 1,3-diaminopropanetetraacetic acid), and persulfates. Among these, aminopolycarboxylic acid iron (III) complex salts are preferable in view of attaining the effect of present invention effectively. Further, aminopolycarboxylic acid iron (III) complex salts are particularly useful in a bleaching solution as well as a bleach-fixing solution. A bleaching solution or a bleach-fixing solution using these aminopolycarboxylic acid iron (III) complex salts is used generally at a pH of 3.5 to 8.

In the bleaching solution or the bleach-fixing solution, known additives including rehalogenating agents, such as ammonium bromide and ammonium chloride; pH-buffer, such as ammonium nitrate; metal corrosion inhibitors, such as ammonium sulfate may be added.

It is preferable that, in addition to the above mentioned compounds, an organic acid is contained for the purpose of preventing bleaching stain. Particularly preferable organic acid is a compound having 2 to 5.5 of acid dissociation constant (pKa), and specifically acetic acid and propionic acid are preferable.

As a fixing agent for use in bleaching solution, bleach-fixing solution, and the preceding bath thereof can be mentioned thiosulfates, thiocyanates, thioether-type compounds, thioureas, and large amounts of iodide salts, although thiosulfate is used usually, and in particular ammonium thiosulfate is widely used. The combination use of thiosulfate and thiocyanate, thioether-type compound, or thiourea is preferable.

As the preservative for bleaching solution and bleach-fixing solution, sulfite salt, bisulfite salt, carbonyl-bisulfite adduct, or sulfinic acid compound as described in European Patent No. 294769A is preferable. Further, for the purpose of stabilizing solution, the addition of various aminopolycarbonic acids or organic phosphonic acids (e.g., 1-hydroxyethylidene-1,1-diphosphonic acid and N,N,N',N'-ethylenediaminetetraphosphonic acid) is preferable.

Further, various fluorescent whitening agents, antifoamers, surface-active agents, polyvinylpyrrolidone, or methanol can be contained in the fixing solution and bleach-fixing solution.

In bleaching solution, bleach-fixing solution, and the preceding bath thereof, if needed, a bleach-accelerating agent can be used. Specified examples of useful bleach-accelerating agent that can be mentioned include compounds having mercapto group or disulfide group described, for example, in U.S. Pat. No. 3,893,858, West German Patent Nos. 1,290,812 and 2,059,988, JP-A Nos. 32736/1978, 57831/1978, 37418/1978, 72623/1978, 95630/1978, 95631/1978, 104232/1978, 124424/1978, 141623/197S, and 28426/1978, and *Research Disclosure* No. 17129 (July, 1978); thiazolizine derivatives described, for example, in JP-A No. 140129/1975; thiourea derivatives described, for example, in JP-B No. 8506/1970, JP-A Nos. 20832/1977 and 32735/1978, and U.S. Pat. No. 3,706,561; iodide salts described, for example, in West German Patent No. 1,127,715 and JP-A No. 16235/1983; polyoxyethylene compounds described, for example, in West German Patent Nos. 966,410 and 2,748,430; polyamine compound described, for example, in JP-B No. 8836/1970; other compounds described, for example, in JP-A Nos. 42434/1974, 59644/1974, 94927/1978, 35727/1979, 26506/1980, and 163940/1983; and bromide ions. Among them, compounds having mercapto group or disulfide group are preferable in view of large accelerating effect, and particularly compounds described in U.S. Pat. No. 3,893,585, West German Patent No. 1,290,812, and JP-A No. 95630/1978 are preferable. Further, compounds described in U.S. Pat. No. 4,552,834 are also preferable. These bleach-accelerating agent may be added in a photographic material. These bleach-accelerating agents are particularly effective in bleach-fixing of color photographic materials for photographing.

The total time of desilvering is preferably as short as in the range of not occurring insufficient desilvering. Preferable time is in 1 min to 3 min. The processing temperature may be 25° to 50° C., preferably 35° to 45° C.

In a desilvering process, it is preferable that stirring is as strong as possible. Specific method for strengthening stirring can be mentioned a method in which the jet stream of processing solution strikes the emulsion surface of photographic material, described in JP-A No. 183460/1987. Such means for strengthening stirring is effective for any of bleaching solution, bleach-fixing solution, and fixing solution.

It is common for the photographic material of the present invention to undergo a washing process after a desilvering process. A stabilizing process may be conducted instead of a washing process. In such stabilizing process any known method described, for example, in JP-A Nos. 8543/1982, 14834/1983, and 220345/1985 may be used. Further such a washing-stabilizing process in which a stabilizing bath containing a color-dye stabilizer and a surface-active agent is used as a final bath, that represents a processing of color photographic material for photographing, may be carried out.

In a washing solution and a stabilizing solution, hard-water softeners, such as inorganic phosphoric acid, polyaminocarbonic acid, organic aninophosphonic acid; isothiazolone compounds, cyabendazoles, and chlorine series germicides, such as chlorinated sodium isocyanurate; metal salts, such as Mg salt, Al salt, and Bi salt; surface-active agents; film hardeners; and germicides may be contained.

The amount of washing water may be set within a wide range depending on the characteristics (e.g., due to the materials used, such as couplers), the application of the photographic material, the washing temperature, the number of washing tanks (the number of steps), the type of replenishing system, including, for example, the counter-current system and the direct flow system and other various conditions. Of these, the relationship between the number of water-washing tanks and the amount of washing water in the multi-stage counter current system can be found according to the method described in *Journal of Society of Motion Picture and Television Engineers*, Vol. 64, pages 248 to 253 (May 1955). Further, a method described in JP-A No. 288838/1987 to reduce calcium ions and magnesium ions may be used remarkably effectively.

The pH of the washing water may be 4 to 9, preferably 5 to 8. The washing water temperature and the washing time may be set depending, for example, on the characteristics and the application of the photographic material, and they are generally selected in the range of 15° to 45° C. for 20 sec to 10 min, and preferably in the range of 25° to 40° C. for 30 sec to 5 min.

As dye-stabilizers that may be used in a stabilizing solution can be mentioned aldehydes, such as formalin and glutaraldehyde; N-methylol compounds, such as dimethylolurea; hexamethylenetetramine; and aldehyde sulfurous acid adduct. Further, a buffer for pH adjusting, such as boric acid and sodium hydroxide; a chelating agent, such as 1-hydroxyethylidene-1,1-diphosphnic acid and ethylenediaminetetraacetic acid; a sulfidation inhibitor, such as Alkanol; a fluorescent whitening agent; an antiseptics may be contained in a stabilizing solution.

The over-flowed solution resulting from the replenishing of washing solution and/or stabilizing solution may be reused in other steps, such as a desilvering step.

The silver halide color photographic material of the present invention may contain therein a color-developing agent for the purpose of simplifying and quickening the process. To contain such a color-developing agent, it is preferable to use a precursor for color-developing agent. For example, indoaniline-type compounds described in U.S. Pat. No. 3,342,597, Schiff base-type compounds described in U.S. Pat. No. 3,342,599 and *Research Disclosure* Nos. 14850 and 15159, aldol compounds described in *Research Disclosure* No. 13924, and metal salt complexes described in U.S. Pat. No. 3,719,492, and urethane-type compounds described in JP-A No. 135628/1978 can be mentioned.

For the purpose of accelerating the color development, the present silver halide color photographic material may contain, if necessary, various 1-phenyl-3-pyrazolicones. Typical compounds are described in JP-A Nos. 64339/1981, 144547/1982, and 115438/1983.

The various processing solutions used for the present invention may be used at 10° to 50° C. Although generally a temperature of 33° to 38° C. may be standard, a higher temperature can be used to accelerate the process to reduce the processing time, or a lower temperature can be used to improve the image quality or the stability of the processing solution.

According to the present coupler, a color-formed dye can be provided wherein the coupling activity is high, the molecular absorption coefficient is large, and the fastness is excellent; and according to the photographic material containing the present coupler, a color image that is good in sharpness of the image and that is fast can be obtained.

Next, the present invention will be described in detail in accordance with examples, but the invention is not limited to these examples.

EXAMPLE 1

Synthesis of Exemplified couplers (1) and (60)

Exemplified couplers (1) and (60) were synthesized in accordance with the following route.

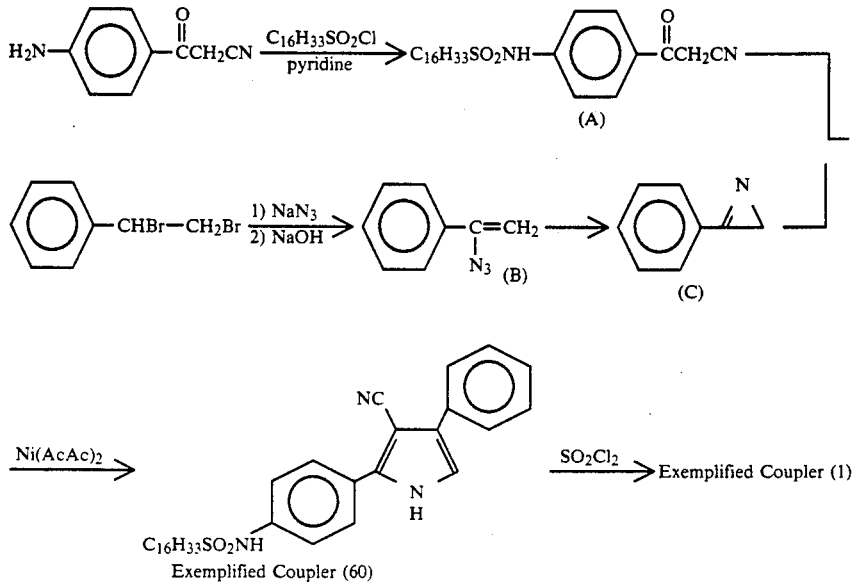

Synthesis of Compound (A)

32.5 g of hexadecylsulfonyl chloride was added little by little to a mixture of 16.0 g of p-aminobenzoylacetonitrile (op of CN : 0.66), 20 ml of pyridine, and 80 ml of acetonitrile while being cooled with ice. After the addition the mixture was stirred for 30 min at room temperature, and the reaction liquid was poured to cold diluted hydrochloric acid and was subjected to extraction with ethyl acetate.

The extract liquid was washed with water and dried, the ethyl acetate was distilled off under reduced pressure, acetonitrile was added to the residue to bring about crystallization, and the crystals of (A) were filtered. Yield: 38.5 g.

26.4 g of 1,2-dibromostyrene was dissolved in 150 ml of dimethylsulfoxide, then 9.8 g of sodium azide was added little by little at 15° to 18° C. in an atmosphere of nitrogen, and the mixture was stirred at room temperature for 10 hours. Then the reaction mixture was cooled to 10° C. and 10 g of a 50% aqueous sodium hydroxide solution was added dropwise thereto. After the addition the reaction mixture was stirred for 24 hours at room temperature, then 400 ml of a 2% aqueous sodium hydrogencarbonate solution was poured to it, and extraction with 150 ml of methylene chloride was carried out. After drying the extract liquid the solvent was distilled off under reduced pressure. 50 ml of n-hexane was added to the residue and the solution was treated by simple column chromatography, wherein the column was filled with 50 g of alumina (eluent: n-hexane). The solvent was removed from the elutant by distillation under reduced pressure, to obtain 14.4 g of 1-azidostyrene (B).

200 ml of toluene was added to the 1-azidostyrene, the mixture was heated under reflux for 1 hour, and the toluene was distilled off under reduced pressure, to obtain 11.2 g of 2-phenylazirin (C) 13.5 g of Compound (A) and 3.6 g of Compound (C) were dissolved in 50 ml of acetone, and then 0.05 g of nickel acetylacetonate was added followed by stirring for 3 hours at room temperature. After distilling the acetone off from the reaction liquid, the residue was purified by silica gel chromatography (eluent: n-hexane/ethyl acetate =3/1), to obtain 12.5 g of Exemplified Coupler (60).

5.5 g of Exemplified Coupler (60) was dissolved in 30 ml of methylene chloride and a mixture of 1.35 g of sulfuryl chloride and 5 ml of methylene chloride was added thereto dropwise at −10° C. After the addition the mixture was stirred at −10 to −5° C. for 30 min, then water was added to the reaction liquid to carry out washing. After the methylene chloride was distilled off the residue was purified by silica gel chromatography (eluent: n-hexane/ethyl acetate=3/1), to obtain 3.1 g of crystals of Exemplified Coupler (1) of the present invention. m.p.: 132 to 136° C.

Example 2

Synthesis of Exemplified Coupler (17) (synthesized through the following synthesis route)

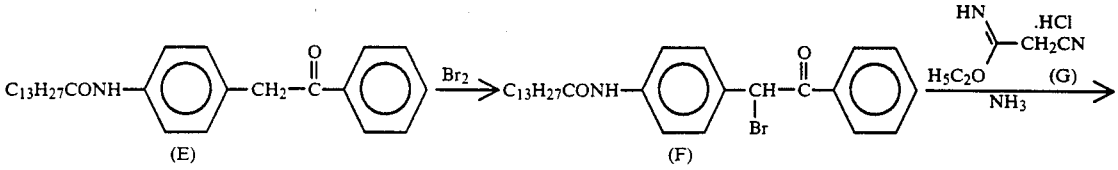

-continued

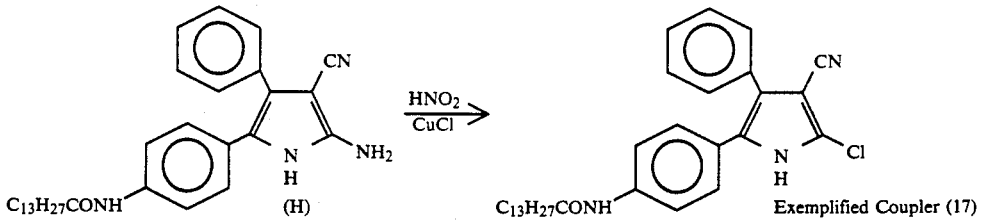

42.1 g of 4-tetradecanoylaminobenzyl phenyl ketone (E) was dissolved in 500 ml of chloroform and 16.0 g of bromine was added thereto dropwise at room temperature. After the mixture was stirred for 2 hours at room temperature the solvent was distilled off, to obtain 50.0 g of an intermediate (F). 200 ml of ethanol was saturated with ammonia gas, then 14.9 g of malononitrilemonoimidato (G) was added thereto, and 25.0 g of the above intermediate (F) was added to the mixture at room temperature. After the mixture was stirred at room temperature for 8 hours the solvent was distilled off then 100 ml of acetonitrile and 20 ml of water were added to the residue and the resulting precipitate was filtered, to obtain 16.4 g of an intermediate (H).

9.5 g of the intermediate (H) was dissolved in 50 ml of methyl Cellosolve and the solution was saturated with HCl gas while being cooled with ice. Then a solution of 1.52 g of sodium nitrite in 5 ml of water was added dropwise thereto at 5° to 8° C. After stirring at that temperature for 30 min 9.9 g of cuprous chloride was added followed by stirring at room temperature for 3 hours. After distilling the solvent off the residue was subjected to extraction with ethyl acetate, the organic layer was washed with water and dried, then the solvent was distilled off and the residue was purified by silica gel chromatography (eluent: n-hexane/ethyl acetate 2/1), to obtain 4.4 g of Exemplified Coupler (17).

Example 3

The absorption spectrum of the dye obtained by oxidation coupling of Exemplified Coupler (1) of Cyan Coupler (A-I) with 2-methyl-4-(N-ethyl-N-methanesulfonylethylamino) aniline is shown in FIG. 1. It can be understood that, compared to the comparative cyan dye, the absorption is remarkably sharp and the subsidiary absorption is small.

Cyan Coupler (A-I)

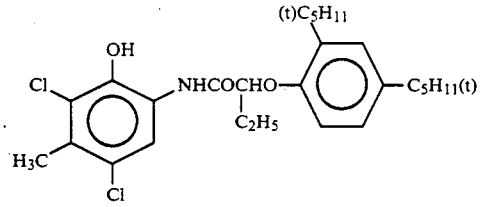

Dye D1 of the present invention

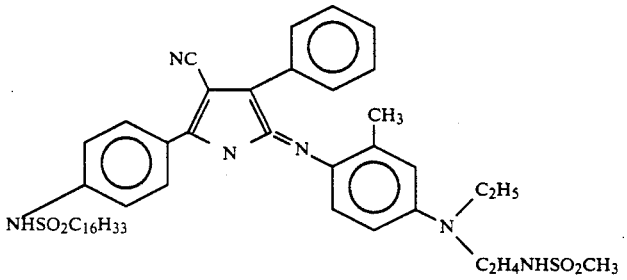

Dye D2 for comparison

-continued

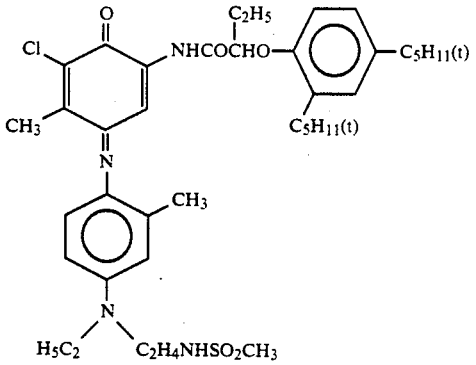

The molecular absorption coefficient ($\epsilon$) of Dye D1 was $6.78\times10^4$ (in acetonitrile), and was 3 times larger than that of Comparative Dye D2 ($\epsilon=2.37\times10^4$).

Figure 2:
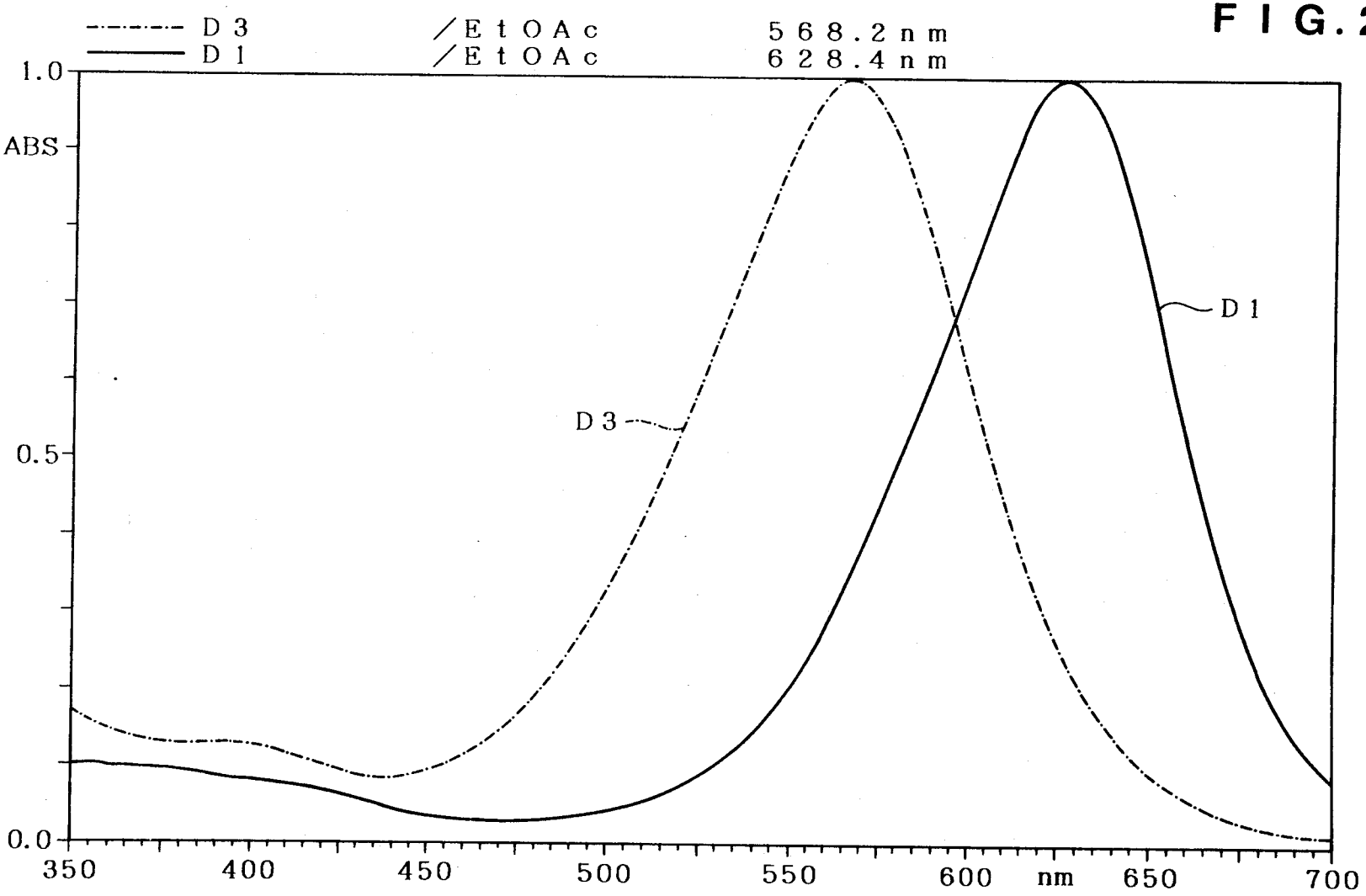

The absorption spectra of the dyes obtained by oxidation coupling of D1 and the coupler (A-II) shown below which is described in U.S. Pat. No. 2,396,396 with 2-methyl-4-(N-ehtyl-N-methanesulfonylethylamino)aniline are shown in FIG. 2. Thus, in the case of Coupler (A-II), the $\sigma_p$ value of the phenyl group is 0 and λmax is 568.2 nm, and it can be understood that the Coupler (A-II) is not effective as a cyan coupler.

Coupler (A-II)

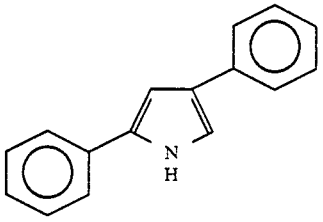

EXAMPLE 4

Preparation of Sample 101

Sample 101 was prepared of the following layer constitution on a cellulose triacetate film base. A first layer coating solution was prepared as follows. (Preparation of a first layer coating solution)

1.01 g of Cyan Coupler (A-I) and 0.65 g of dibutyl phthalate were dissolved completely in 10.0 ml of ethyl acetate. This ethyl acetate solution containing the Cyan Coupler was added to 42 g of a 10% aqueous gelatin solution (containing sodium dodecylbenzenesulfonate in an amount of 5 g/l) and was emulsified and dispersed therein by a homogenizer. After the emulsification and dispersion, distilled water was added to make the total amount to be 100 g. 100 g of the emulsified dispersion and 8.2 g of a high-silver-chloride emulsion (having a silver bromide content of 0.5 mol. %) were mixed and dissolved to prepare a first coating solution that would have the composition given below. As a gelatin hardener,1-oxy-3,5-dichloro-s-triazine sodium salt was used.

Layer Constitution

The constitutions of the layers are shown below.

Base

Cellulose triacetate film

| First layer (emulsion layer) | |
|---|---|
| High-silver-chloride emulsion (in terms of silver) | 0.32 g/m$^2$ |
| Gelatin | 2.50 g/m$^2$ |
| Cyan Coupler (A-I) | 0.49 g/m$^2$ |
| Dibutyl phthalate | 0.32 g/m$^2$ |
| Second layer (protective layer) | 1.40 g/m$^2$ |
| Gelatin | |

Preparation of Samples 102 to 107

Samples 102 to 107 were prepared in the same procedure for Sample 101, except that instead of Cyan Coupler (A-I) of Sample 101, cyan couplers shown in Table 1 were used in the same molar amount.

Cyan Coupler (A-I)

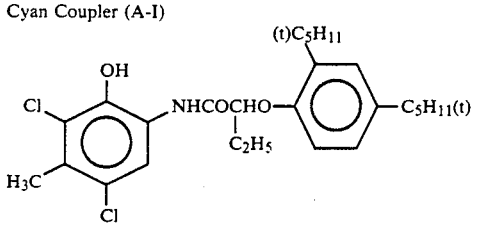

Evaluation of the Hues

The thus prepared Samples 101 to 107 were subjected to step wedge exposure to white light and then were developed in the following processing steps.

After the development processing, spectral absorption measurement of the maximum density part was carried out, and the evaluation of the hues was effected based on the magnitude of the subsidiary absorption given by the following expression and on the decrease of absorbance at the foot part in short wavelength side given by the following expression.

Magnitude of subsidiary absorption=(Absorption density at 430 nm)/(Absorption density at the maximum absorption wavelength)

Decrease of absorbance at the foot part in short wavelength side=(Absorption density at 535 nm)/(Absorption density at the maximum absorption wavelength)

The results are summarized in Table 1.

| Processing step | Temperature | Time |
|---|---|---|
| Color development | 38° C. | 45 sec |
| Bleach-fixing | 35° C. | 45 sec |
| Rinse (1) | 35° C. | 30 sec |
| Rinse (2) | 35° C. | 30 sec |
| Rinse (3) | 35° C. | 30 sec |
| Drying | 80° C. | 60 sec |

(Rinse steps were conducted in a three-tank counterflow system moving from Rinse (3) to (1))

The compositions of the processing solutions were as follows.

| | |
|---|---|
| Color Developer | |
| Water | 800 ml |
| Ethylenediamine-N,N,N,N-tetramethylene phosphonic acid | 3.0 g |
| Triethanolamine | 8.0 g |
| Potassium chloride | 3.1 g |
| Potassium bromide | 0.015 g |
| Potassium carbonate | 25 g |
| Hydrazinodiacetic acid | 5.0 g |
| N-Ethyl-N-(β-methanesulfonamidoethyl)-3-methyl-4-aminoaniline sulfate | 5.0 g |
| Fluorescent whitening agent (WHITEX-4, made by Sumitomo Chemical Co.) | 2.0 g |
| Water to make | 1,000 ml |
| pH (by adding potassium hydroxide) | 10.05 |
| Bleach-fixing Solution | |
| Water | 400 ml |
| Ammonium thiosulfate (700 g/l) | 100 ml |
| Ammonium sulfite | 45 g |
| Fe(III) ammonium ethylenediaminetetraacetate | 55 g |
| Ethylenediaminetetraacetic acid | 3 g |
| Ammonium bromide | 30 g |
| Nitric acid (67%) | 27 g |
| Water to make | 1,000 ml |
| pH | 6.2 |
| Rinse Solution | |
| Ion-exchanged water (calcium and magnesium each are 3 ppm or less) | |

TABLE 1

| Sample No. | Coupler | Magnitude of subsidiary Absorption | Decrease of absorbance at the foot part | Remarks |
|---|---|---|---|---|
| 101 | A-1 | 0.124 | 0.137 | Comparative example |
| 102 | Exemplified coupler (1) | 0.072 | 0.103 | This invention |
| 103 | Exemplified coupler (3) | 0.063 | 0.099 | This invention |
| 104 | Exemplified coupler (4) | 0.067 | 0.101 | This invention |
| 105 | Exemplified coupler (5) | 0.064 | 0.100 | This invention |
| 106 | Exemplified coupler (17) | 0.066 | 0.101 | This invention |
| 107 | Exemplified coupler (28) | 0.065 | 0.099 | This invention |

As is apparent from Table 1, coupler of the present invention can form a dye small in subsidiary absorption and good in increase of absorbance at the foot part in short wavelength side.

EXAMPLE 5

Samples were prepared in the same manner as in Example 4, except that silver iodobromide emulsion (silver iodide: 8.0 mol. %) was used instead of high-silver-chloride emulsion. Samples exchanged emulsion were referred to as Samples 201 to 207.

Thus prepared samples were subjected to the development processing of processing process shown below and evaluated in the same procedure as in Example 4.

Results are summarized in Table 2.

| Processing Process | | |
|---|---|---|
| Process | Processing Time | Processing Temperature |
| Color developing | 3 min 15 sec | 38° C. |
| Bleaching | 1 min 00 sec | 38° C. |
| Bleach-fixing | 3 min 15 sec | 38° C. |
| Water washing (1) | 40 sec | 35° C. |
| Water washing (2) | 1 min 00 sec | 35° C. |
| Stabilizing | 40 sec | 38° C. |
| Drying | 1 min 15 sec | 55° C. |

Composition of each processing solution are shown below.

| | (gram) |
|---|---|
| (Color Developer) | |
| Diethylenetriaminepentaacetic acid | 1.0 |
| 1-hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-[N-Ethyl-N-β-hydroxyethylamino)-2-methylaniline sulfate | 4.5 |
| Water to make | 1,000 ml |
| pH | 10.05 |
| (Bleaching Solution) | |
| Fe(III) ammonium ethylenediaminetetraacetate dihydrate | 120.0 |
| Disodium ethylenediaminetetraacetate | 10.0 |
| Ammonium bromide | 100.0 |
| Ammonium nitrate | 10.0 |
| Bleach-accelerator | 0.005 mol |

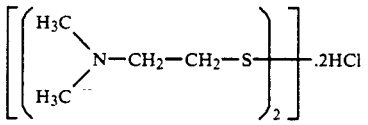

| | |
|---|---|
| Aqueous ammonia (27%) | 15.0 ml |
| Water to make | 1,000 ml |
| pH | 6.3 |
| (Bleach-fixing solution) | |
| Fe(III) ammonium ethylenediaminetetraacetate dihydrate | 50.0 |
| Disodium ethylenediaminetetraacetate | 5.0 |
| Sodium sulfite | 12.0 |
| Ammonium thiosulfate (aq. solution: 70 g/l) | 240.0 ml |
| Aqueous ammonium (27%) | 6.0 ml |
| Water to make | 1,000 ml |
| pH | 7.2 |

Water Washing Solution

Tap water was treated by passing through a mixed bed ion-exchange column filled with H-type strong acidic cation exchange resin (Amberlite IR-120B, tradename, made by Rohm & Haas) and OH-type strong basic anion exchange resin (Amberlite IRA-400, the same as the above) so that the concentration of calcium ions and magnesium ions both decrease to 3 mg/l or below. To the thus-obtained ion-exchanged water 20 mg/l of sodium dichlorinated isocyanurate and 150 mg/l of sodium nitrate were added. The pH of this water was in a range of 6.5 to 7.5.

| (Stabilizing solution) | (gram) |
|---|---|
| Formalin (37%) | 2.0 ml |
| Polyoxyethylene-p-monononylphenyl ether (av. polymerization degree: 10) | 0.3 |
| Disodium ethylenediaminetetraacetate | 0.05 |
| Water to make | 1,000 ml |
| pH | 5.0–8.0 |

TABLE 2

| Sample No. | Coupler | Magnitude of subsidiary Absorption | Decrease of absorbance at the foot part | Remarks |
|---|---|---|---|---|
| 201 | A-1 | 0.127 | 0.110 | Comparative example |
| 202 | Exemplified coupler (1) | 0.094 | 0.097 | This invention |
| 203 | Exemplified coupler (3) | 0.071 | 0.075 | This invention |
| 204 | Exemplified coupler (4) | 0.080 | 0.084 | This invention |
| 205 | Exemplified coupler (5) | 0.081 | 0.082 | This invention |
| 206 | Exemplified coupler (17) | 0.082 | 0.083 | This invention |
| 207 | Exemplified coupler (28) | 0.079 | 0.081 | This invention |

As is apparent from Table 2, coupler of the present invention can form a dye small in subsidiary absorption and good in decrease of absorbance at the foot part in short wavelength side.

EXAMPLE 6

The same examination and evaluation as in Example 5 were conducted, except that the processing was carried out according to the process shown below.

Results are summarized in Table 3.

| Processing process | | |
|---|---|---|
| Process | Time | Temperature |
| First development | 6 min | 38° C. |
| Water washing | 2 min | 38° C. |
| Reversal | 2 min | 38° C. |
| Color developing | 6 min | 38° C. |
| Compensating | 2 min | 38° C. |
| Bleaching | 6 min | 38° C. |
| Fixing | 4 min | 38° C. |
| Water washing | 4 min | 38° C. |
| Stabilizing | 1 min | Ordinary temperature |
| Drying | | |

Processing solutions each having composition shown below are used.

| | |
|---|---|
| First developing solution | |
| Water | 700 ml |
| Pentasodium nitrilo-N,N,N-trimethylene phosphonate | 2 g |
| Sodium sulfite | 20 g |
| Hydroquinone monosulfonate | 30 g |
| Sodium carbonate (monohydrate) | 30 g |
| 1-Phenyl-4-methyl-4-hydroxymethyl-3-pyrazolidone | 2 g |
| Potassium bromide | 2.5 g |

-continued

| | |
|---|---|
| Potassium thiocyanate | 1.2 g |
| Potassium iodide (0.1% solution) | 2 ml |
| Water to make | 1,000 ml |
| pH | 9.60 |
| Reversal solution | |
| Water | 700 ml |
| Pentasodium nitrilo-N,N,N-trimethylene phosphonate | 3 g |
| Stannous chloride (dihydrate) | 1 g |
| p-Aminophenol | 0.1 g |
| Sodium hydroxide | 8 g |
| Glacial acetic acid | 15 ml |
| Water to make | 1,000 ml |
| pH | 6.00 |
| Color developer | |
| Water | 700 ml |
| Pentasodium nitrilo-N,N,N-trimethylene phosphonate | 3 g |
| Sodium sulfite | 7 g |
| Sodium tertiaryphosphate ($12H_2O$) | 36 g |
| Potassium bromide | 1 g |
| Potassium iodide (0.1% solution) | 90 ml |
| Sodium hydroxide | 3 g |
| Citrazinic acid | 1.5 g |
| N-Ethyl-N-(β-methanesulfonamidoethyl)-3-methyl-4-aminoaniline sulfate | 11 g |
| 3,6-Dithiaoctane-1,8-diol | 1 g |
| Water to make | 1,000 ml |
| pH | 11.80 |
| Compensating solution | |
| Water | 700 ml |
| Sodium sulfite | 12 g |
| Sodium ethylenediaminetetraacetate (dihydrate) | 8 g |
| Thioglycerin | 0.4 ml |
| Glacial acetic acid | 3 ml |
| Water to make | 1,000 ml |
| pH | 6.60 |
| Bleaching solution | |
| Water | 800 ml |
| Sodium ethylenediaminetetraacetate (dihydrate) | 2 g |
| Fe(III) ammonium ethylene-diaminetetraacetate (dihydrate) | 120 g |
| Potassium bromide | 100 g |
| Water to make | 1,000 ml |
| pH | 5.70 |
| Fixing solution | |
| Water | 800 ml |
| Sodium thiosulfate | 80.0 g |
| Sodium sulfite | 5.0 g |
| Sodium hydrogensulsite | 5.0 g |
| Water to make | 1,000 ml |
| pH | 6.60 |
| Stabilizing solution | |
| Water | 800 ml |
| Formarin (37 wt %) | 5.0 g |
| Fuji Driwel (surface-active agent, tradename, made by Fuji Photo Film Co., Ltd.) | 5.0 ml |
| Water to make | 1,000 ml |
| pH | 7.00 |

TABLE 3

| Sample No. | Coupler | Magnitude of subsidiary Absorption | Decrease of absorbance at the foot part | Remarks |
|---|---|---|---|---|
| 201 | A-1 | 0.125 | 0.138 | Comparative example |
| 202 | Exemplified coupler (1) | 0.069 | 0.104 | This invention |
| 203 | Exemplified coupler (3) | 0.065 | 0.100 | This invention |
| 204 | Exemplified coupler (4) | 0.068 | 0.101 | This invention |
| 205 | Exemplified coupler (5) | 0.067 | 0.100 | This invention |

TABLE 3-continued

| Sample No. | Coupler | Magnitude of subsidiary Absorption | Decrease of absorbance at the foot part | Remarks |
|---|---|---|---|---|
| 206 | Exemplified coupler (17) | 0.069 | 0.102 | This invention |
| 207 | Exemplified coupler (28) | 0.070 | 0.103 | This invention |

As is apparent from Table 3, coupler of the present invention can form a dye small in subsidiary absorption and good in decrease of absorbance at the foot part in short wavelength side.

EXAMPLE 7

As a silver halide color photographic material, the same photographic material as Sample No. 214 (multilayer color paper) described in Publication of European Patent EP 0,355,660A2 (corresponding to JP-A No. 139544/1990 and U.S. Ser. No. 07/383,747), Example 2 was used, except that as a bisphenol compound, III-10 was used instead of III-23; yellow coupler (ExY), Image-dye stabilizer (Cpd-8), solvent (Solv-7), and oxonol dye were changed to compounds shown below; the compound shown below was used as antiseptic (anticrobial and antifungal agent); and as a cyan coupler, exemplified coupler (1), (3), (4), (5), (17), and (28) were used. (ExY) Yellow coupler Mixture (1:1 in molar ratio) of

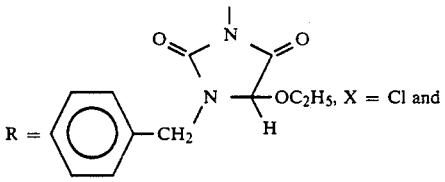

-continued

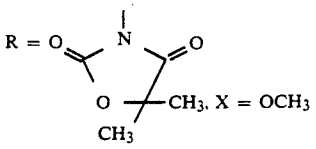

of the following formula:

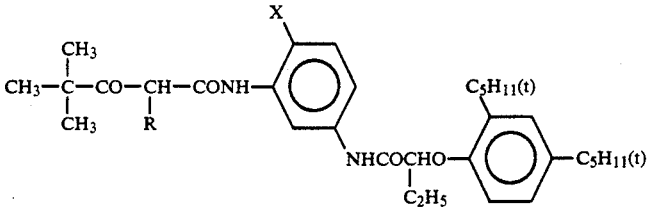

(Cpd-8) Image stabilizer

Mixture (1:1 in molar ratio) of

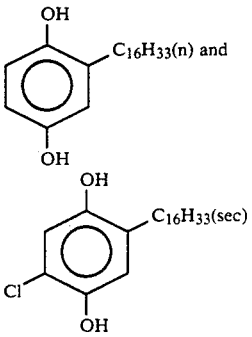

(Cpd-10) Antiseptic

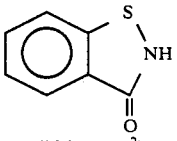

(25.0 mg/m$^2$)

(Cpd-11) Antiseptic

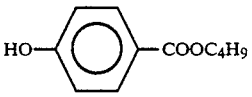

(50.0 mg/m$^2$)

(Solv-6) Solvent

Mixture (9:1 in weight ratio) of

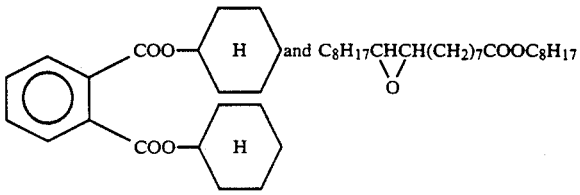

(Oxanol compound)

-continued

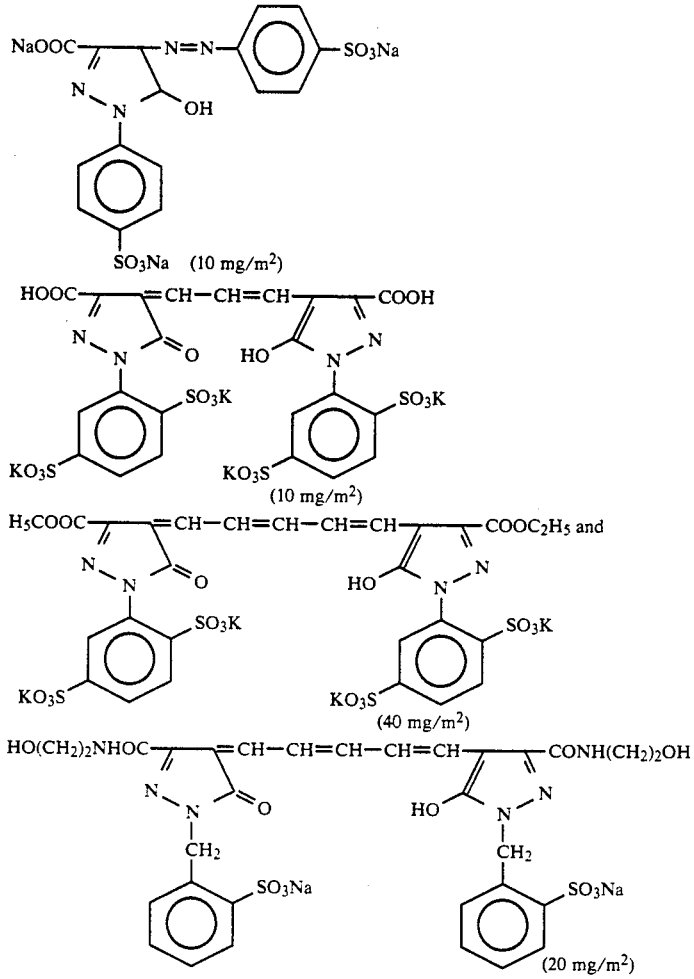

The color photographic material was subjected to color development processing in the way described in Example 4.

As a result, good color reproduction (particularly of green) was shown.

Having described our invention as related to the embodiment, it is our intention that the invention be not limited by any of the details of the description, unless otherwise specified, but rather be construed broadly within its spirit and scope as set out in the accompanying claims.

What we claim is:

1. A silver halide color photographic material comprising at least one cyan dye-forming coupler represented by formula (I):

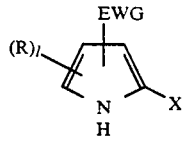

(I)

wherein EWG represents an electron-attractive group having a Hammett substituent constant $\sigma_p$ value of 0.30 or more and is selected from the group consisting of a cyano group, an aliphatic or aromatic sulfonyl group, an aliphatic or aromatic acyl group, or a perfluoroalkyl group, R is selected from the group consisting of an aromatic group, a heterocyclic group, an alkoxy group, an amido group, an ureido group, and an amino group, l represents an integer of 0 to 2, X represents a hydrogen atom or a group capable of being released upon coupling reaction with the oxidized product of an aromatic primary amine derivative, and when l is 2, the two Rs may be the same of different.

2. The silver halide color photographic material as claimed in claim 1, wherein the coupler represented by formula (I) is added in an amount of $1\times10^{-3}$ to 1 mol per mol of silver halide in the silver halide color photographic material.

3. The silver halide color photographic material as claimed in claim 1, wherein the electron-attractive group represented by EWG in formula (I) is selected from the group consisting of a cyano group, and a perfluoroalkyl group.

4. The silver halide color photographic material as claimed in claim 1, wherein EWG in formula (I) is substituted on the 3- or 4-position of the pyrrole ring.

5. The silver halide color photographic material as claimed in claim 1, wherein l in formula (I) is 1 or 2.

6. The silver halide color photographic material as claimed in claim 1, wherein l in formula (I) is 2.

7. The silver halide color photographic material as claimed in claim 1, wherein X in formula (I) is selected from the group consisting of a hydrogen atom, a halogen atom, an alkoxy group, an aryloxy group, an acyloxy group, an aliphatic or aromatic sulfonyloxy group, an acylamino group, an aliphatic or aromatic sulfonamido group, an alkoxycarbonyloxy group, an aryloxycarbonyloxy group, an aliphatic, aromatic, or heterocyclic thio group, a carbamoylamino group, a 5- or 6-membered nitrogen-containing heterocyclic group, an imido group, an aromatic azo group, and a carboxyl group.

8. The silver halide color photographic material as claimed in claim 1, wherein X in formula (I) is selected from the group consisting of a halogen atom, an aryloxy group, and an arylthio groups.

9. The silver halide color photographic material as claimed in claim 1, wherein EWG in formula (I) represents a cyano group.

10. The silver halide color photographic material as claimed in claim 1, wherein R in formula (I) represents an aromatic group, a heterocyclic group, an amido group or a ureido group.

* * * * *